US006041857A

United States Patent [19]

Carmody et al.

[11] Patent Number: 6,041,857

[45] Date of Patent: Mar. 28, 2000

[54] MOTOR DRIVE ACTUATOR FOR DOWNHOLE FLOW CONTROL DEVICES

[75] Inventors: Michael A. Carmody, Houston; Kevin R. Jones, Humble; Robert J. Coon, Houston; Douglas J. Murray, Humble; Mark E. Hopmann, Alvin; Steven L. Jennings, Friendswood; Wayne Welch, Houston; Jeffry Edwards, Friendswood; David Martin, Houston, all of Tex.

[73] Assignee: Baker Hughes Incorporated, Houston, Tex.

[21] Appl. No.: 08/930,668

[22] PCT Filed: Feb. 14, 1997

[86] PCT No.: PCT/US97/02334

§ 371 Date: Oct. 14, 1997

§ 102(e) Date: Oct. 14, 1997

[87] PCT Pub. No.: WO97/30269

PCT Pub. Date: Aug. 21, 1997

[51] Int. Cl.[7] ..... E21B 4/04; E21B 33/12

[52] U.S. Cl. ..... 166/66.4; 166/324; 166/332.2; 166/386

[58] Field of Search ..... 166/66.4, 66.5, 166/53, 64, 65.1, 66.6, 319, 386, 321, 324, 330, 332.2, 332.4; 175/40

[56] References Cited

U.S. PATENT DOCUMENTS

| | | | |
|---|---|---|---|
| 4,715,440 | 12/1987 | Boxell et al. | 166/100 |
| 5,220,963 | 6/1993 | Patton | 175/45 |
| 5,234,057 | 8/1993 | Schultz et al. | 166/53 |
| 5,343,963 | 9/1994 | Bouldin et al. | 175/40 |

*Primary Examiner*—Roger Schoeppel
*Attorney, Agent, or Firm*—Cantor Colburn LLP

[57] ABSTRACT

Several motor driven embodiments are discussed which provide linear motion to a downhole flow control device. The embodiments employ ball screw assemblies or lead screw assemblies. A device for rotational actuation of a downhole flow control device is also disclosed.

35 Claims, 28 Drawing Sheets

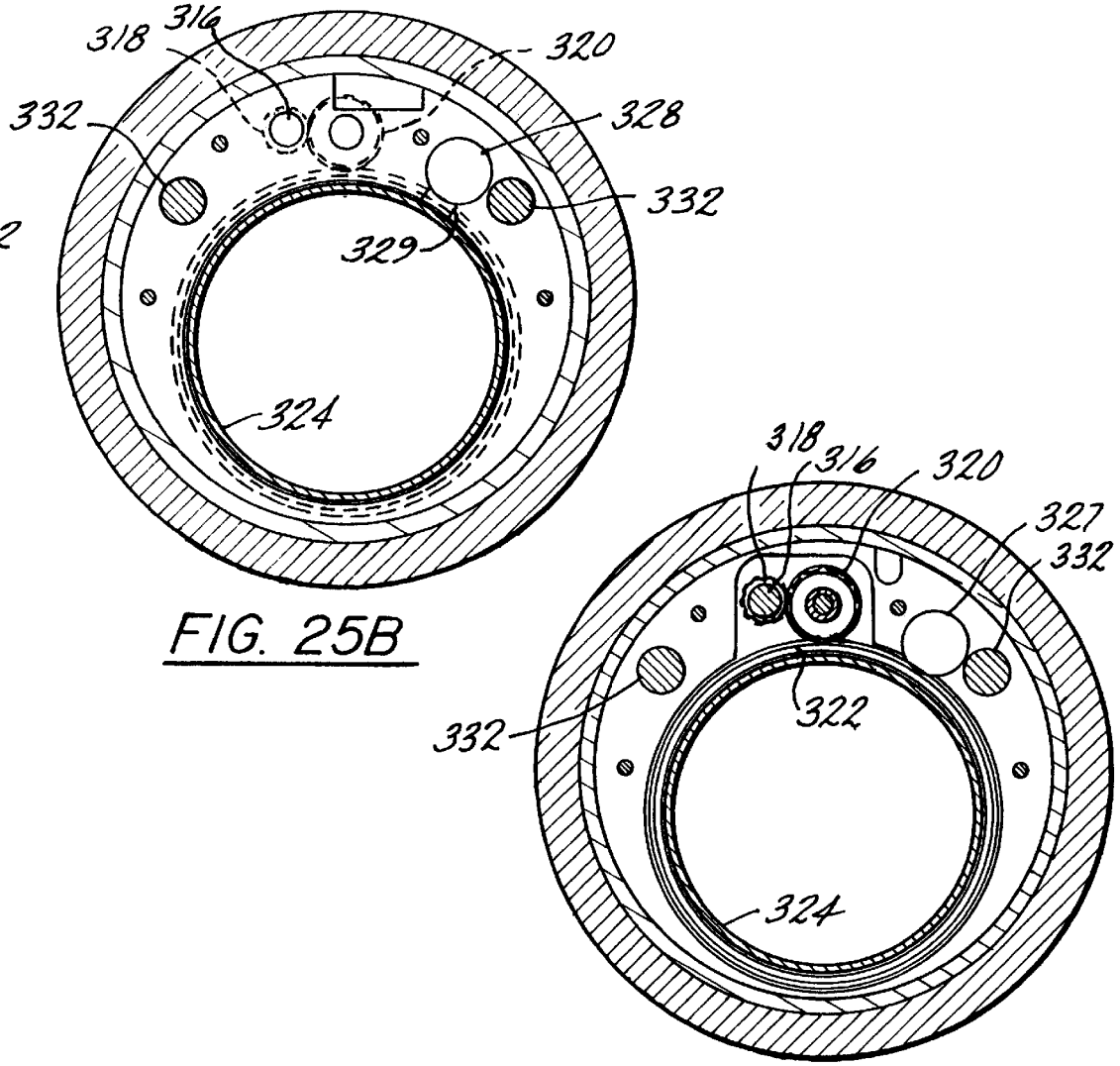
FIG. 25B
FIG. 25C
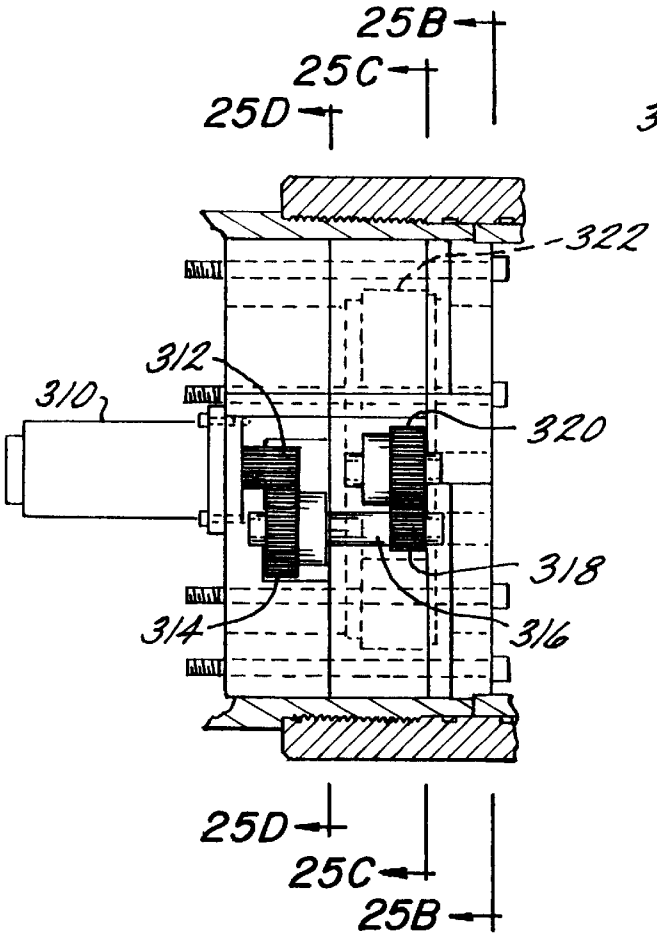
FIG. 25A

MOTOR DRIVE ACTUATOR FOR DOWNHOLE FLOW CONTROL DEVICES

BACKGROUND OF THE INVENTION

1. Field of the Invention

The invention relates to regulating flow of an given fluid in a particular zone into or out of the production tube. More particularly, the invention relates to selective actuation of a flow control device.

2. Prior Art

As one of skill in the art will readily recognize, flow control devices such as the sliding sleeve, commercially available from Baker Oil Tools, 6023 Navigation Boulevard, Houston, Tex. 77011, have been known to the industry and have been depended upon thereby for a number of years. The tool is very effective but does require that a shifting tool be run to open or close the sliding sleeve. Running a shifting tool is time consuming and incurs the characteristic six figure cost associated with any tool run. Moreover, it is sometimes desired to change the positions of the closing sleeve or insert relative to the sleeve housing in metered increments thereby enabling a closer control over the flow device; doing the same through the employment of a shifting tool is extremely difficult. Several miles of wireline, coil tubing, etc., to move in order to actuate the tool makes small position changes nearly impossible.

Due to advancements in downhole electronic actuators and sensors as well as sophisticated decision making electronics which may be either at the surface or downhole such as that disclosed in U.S. Ser. No. 08/385,992 now U.S. Pat. No. 5,732,776 filed Feb. 9, 1995 by Baker Oil Tools and incorporated herein by reference, improved control apparati are more feasible.

SUMMARY OF THE INVENTION

The above-discussed and other drawbacks and deficiencies of the prior art are overcome or alleviated by the electronic actuation mechanisms of the invention. In order to provide reliable and easily meterable flow control device movement, thus reliably regulating flow for any particular zone, a motor and lead screw arrangement or ball screw assembly are provided in several embodiments employing linear actuation and a motor and gear arrangement are provided in another embodiment wherein the sleeve actually rotates to the open or closed position as opposed to linearly sliding open or closed.

In the first lead screw embodiment, the lead screw is rotatably attached to the motor (or motors if desired for enhanced torque characteristics) and is threaded to a sleeve attachment connected to an insert of an otherwise conventional sliding sleeve via a releasable member. The releasable member may be solely shear release or may employ a dog system as well as shear components. Providing power in one polarity to the motor opens the sliding sleeve, reversing polarity closes the sleeve. In the rotatable sleeve embodiment, the motor is operably connected to a gear which drives the rotatable sleeve through teeth (a large ring gear profile) on the sleeve itself. A shearable type release member is not necessary in this embodiment because the threads on the gear will essentially be longitudinally oriented such that the sleeve and the gear are naturally separable from one another. As one of skill in the art will recognize however, an arrangement is required to impart rotational movement to the rotating sleeve; this can be provided by dogs actuated by a pull or push on the assembly.

In both embodiments meterability can be accomplished either by regulating time of power availability to the motor or by employing a specialized stepper motor wherein the counts of the motor are employed to determine the position of the sleeve. Moreover, metered operation is enhanced by employing at least one and preferably a plurality of position sensors to provide accurate information about the position of the closing sleeve to logic circuits either downhole or at the surface. Power may be provided downhole in the form of a battery array or a capacitor arrangement or power may be provided from a surface location. In the event of a failure of the electrical system or motor and gear system, a wireline or coil tubing string may be run with a shifting tool to conventionally activate the sleeve by utilizing shifting profiles. Where the sleeve being operated by the shifting tool is a conventional sliding sleeve, the operation thereof is the same as in the prior art, however if the sleeve is of the rotational type, provision is made whereby the inner rotating sleeve will be separable from the outer sleeve and the outer sleeve will have a blank section therein so that the inner sleeve may simply be moved as if it were a sliding sleeve.

The invention provides greater downhole control by allowing metered machinery and offers speedier execution of sleeve changes.

In another embodiment of the invention a ball screw assembly is employed to provide significantly enhanced motion transfer efficiency. The embodiment employs a brushless annular motor and annular magnet arrangement which allows stepwise movement of the motor. The magnets are mounted on the O.D. of an inner tube and turn upon the impetus provided by energizing of the coils. Due to the interaction between profiles on the motor shaft and a tube sized ball nut, rotation of the shaft drives the ball nut. Ball bearings within the ball nut, ride in the tube sized ball seat which is connected via a shear out assembly to the sliding sleeve insert. Since the ball seat cannot turn with the ball nut due to a key attached to the ball seat and captured in a keyway to prevent such rotation, only linear movement of the ball seat is allowed by the system. Due to the extremely low friction generated by the ball screw assembly, efficiency of motion transfer is at about ninety percent. (In the preferred embodiment about a sixty-eight foot-pound motor generates about 10,000 pounds of linear force). The motor drive components are maintained in optimal condition by being bathed in dielectric fluid, pressure compensated by a series of cylinders and pistons. A shear out assembly is included in this configuration to allow conventional operation of the tool in the event of an actuator failure.

In another embodiment of the invention a ball screw assembly is motor driven to extend a relatively narrow diameter ball seat uphole or downhole depending upon the firing order of the windings in the stator, which is controlled by the downhole electronics and processor package. The ball seat is connected to a connecting shaft which is connected to a drive yoke. The drive yoke is connected via a shear out structure to the insert of an otherwise conventional sliding sleeve. By powering the motor, force may be transmitted to the sliding sleeve to either open or close the same. In the event of failure of the actuation tool, the shear out structure is released and conventional shifting of the sleeve may be initiated.

In yet another embodiment of the invention a second lead screw concept is employed wherein a drive sleeve is threaded on the O.D. thereof and a gear set transmits rotational energy from a motor to a ring gear having I.D. threads mateable to the lead screw drive sleeve threads. The drive sleeve is prevented from rotational movement by a key connected to a position sensor such as a linear potentiometer. While the drive sleeve is prevented from rotating the position sensor is moved with the key to provide an accurate representation of the degree of openness of the sliding sleeve attached to the actuation mechanism of the invention. An electronics and processor package is also provided to monitor and direct operation of the tool.

Each of the latter three embodiments of the invention employ an identical shear out structure or member utilizing a plurality of dogs and a plurality of shear screws. The dogs provide for translation of the energy of movement from the actuator assembly to the sliding sleeve without imparting shear stress to the shear screws. This avoids premature failure of the shear screws and increases longevity of the tool. In the event the actuation mechanisms of the invention fail, the shear out structure may be shifted uphole to release the dogs. Once the dogs have disengaged from the actuation drive mechanism, the tool of the invention allows conventional shifting of the insert in the sliding sleeve by employing a prior art shifting tool on shifting profiles.

BRIEF DESCRIPTION OF THE DRAWINGS

FIG. 19A is a cross section view of FIG. 19 taken along section lines 19A—19A;

FIG. 25A is a plan view of the motor and gear train of the invention taken along line 25A—25A;

FIG. 25B is a cross section view of FIG. 25A taken along section line 25B—25B;

FIG. 25C is a cross section view of FIG. 25A taken along section line 25C—25C;

DETAILED DESCRIPTION OF THE PREFERRED EMBODIMENTS

Figure 1:
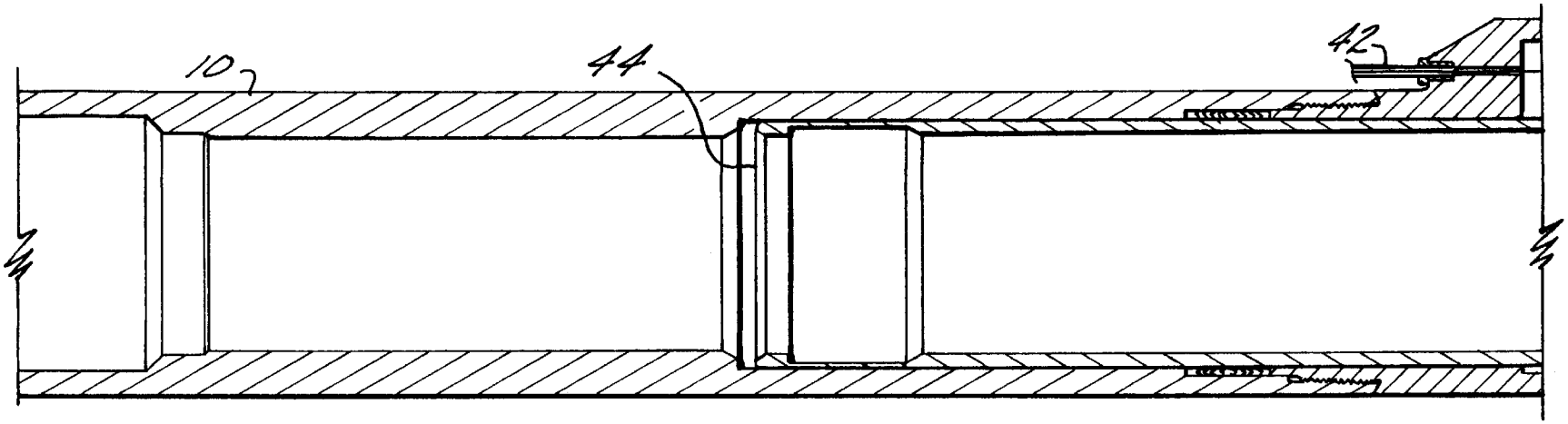
FIGS. 1–3 is a sequential cross section of the invention in a closed position.
Figure 2:
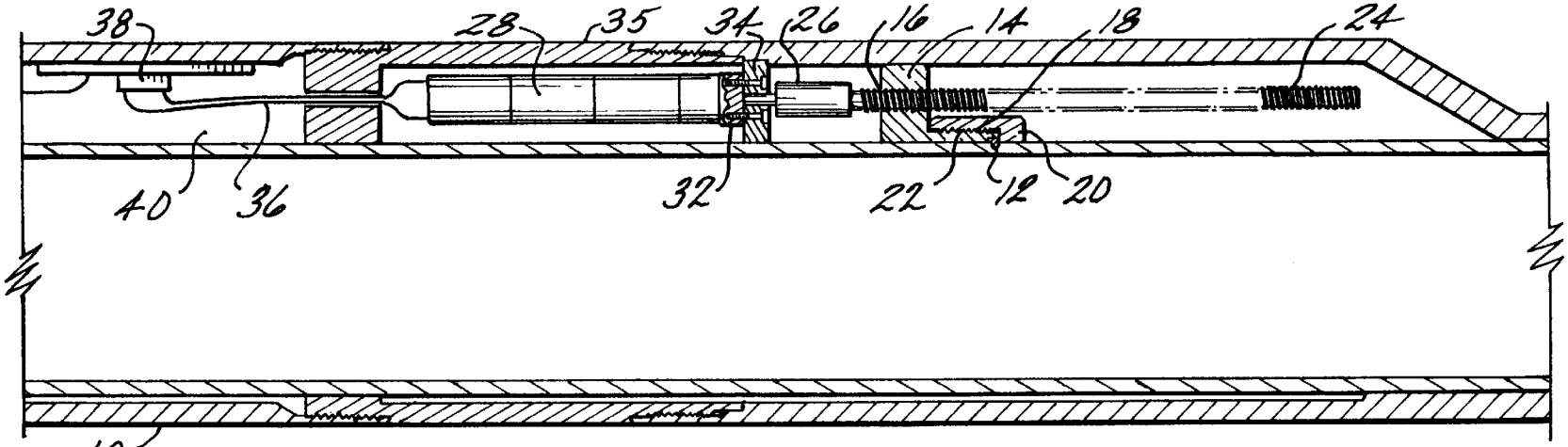
Figure 3:
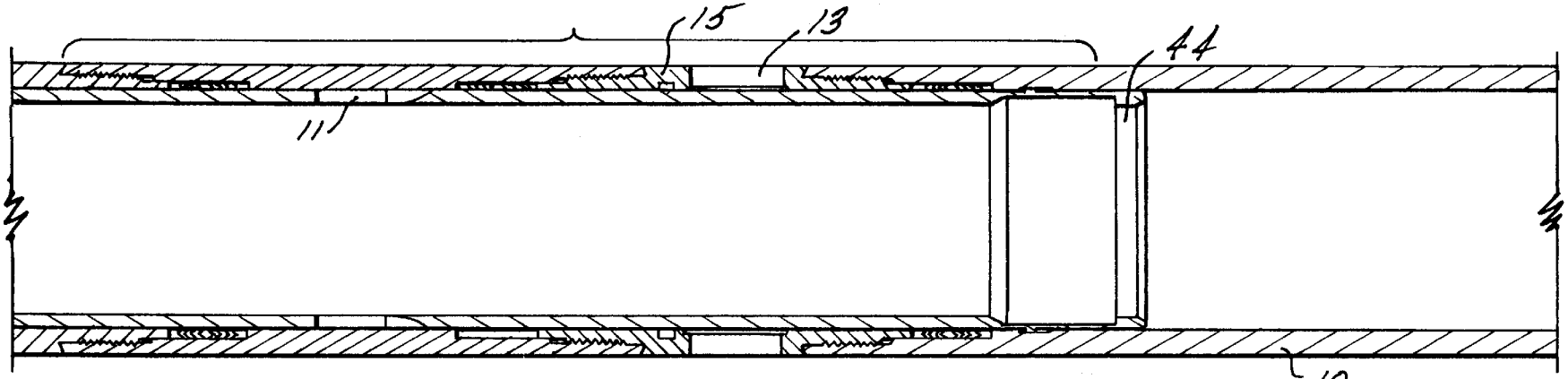
Figure 12:
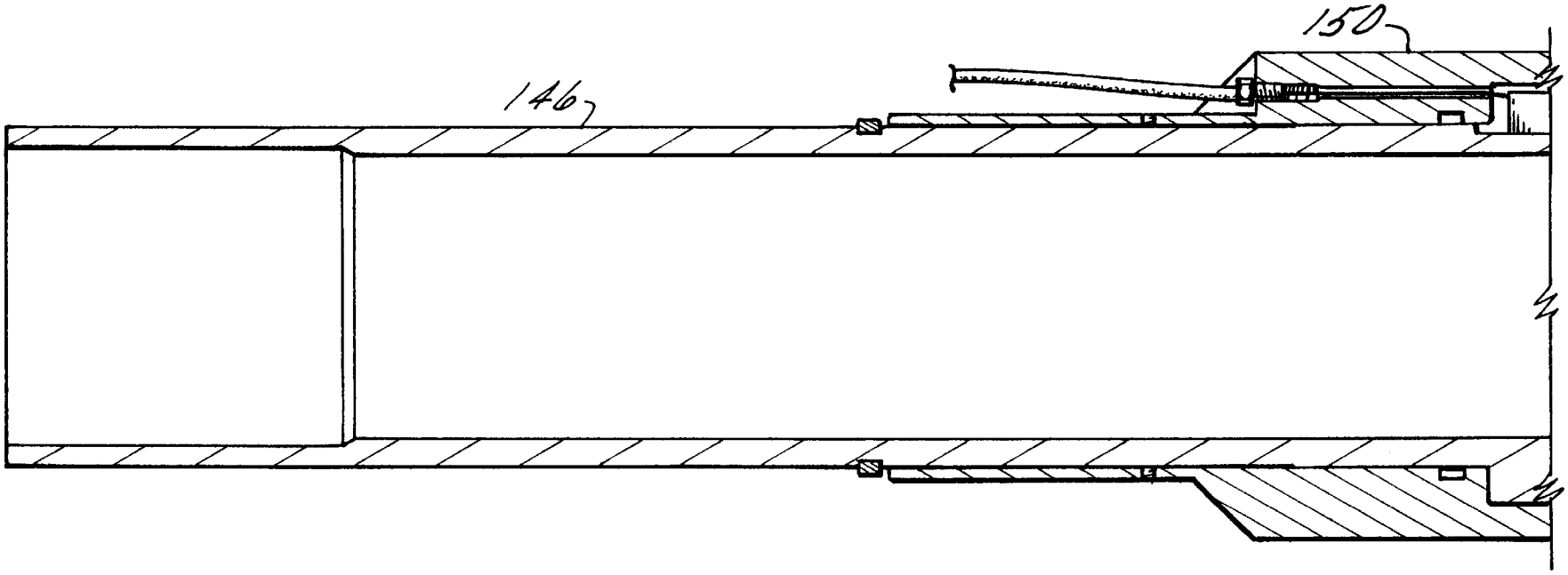
FIGS. 12–17 illustrate an extended view of a longitudinal cross section of an annular ball screw assembly actuator of the invention.

Referring to FIGS. 1–3 the invention is illustrated with the sliding sleeve control device in the closed position. Illustrated is a sliding sleeve commercially available from Baker Oil Tools, 6023 Navigation Road, Houston, Tex. 77011. It will be understood, however, that the apparatus of the invention could easily be modified to actuate other flow control devices. For clarity, 11 indicates an opening in closing sleeve 10 and 13 indicates an opening in housing 15. When 11 and 13 are aligned to any degree the zone will produce. The closing sleeve (or insert) 10 of the sliding sleeve control device is attached by a release mechanism, preferably of a shear type and in the first embodiment may employ a shear ring 12 as illustrated, to sleeve attachment member 14. In the most preferred embodiment however, a separate shear out assembly is employed to take the load of the sleeve off the shear ring during movement of the sleeve. This helps to prevent failure of the device which can otherwise be caused by fatigue of the shear ring 12 from the movement load. The shear assembly is illustrated in the embodiment of FIG. 12 et. seq. but is also employable with this first embodiment the drawings of which do not include the shear out structure. Sleeve attachment member 14 includes a threaded throughbore 16 and pin thread 18. As will be appreciated, pin thread 18 is preferred for assembly purposes so that the shear release 12 may easily be retained by shear retainer 20 which includes box thread 22 adapted to mate with pin thread 18 on sleeve attachment member 14.

Figure 4:
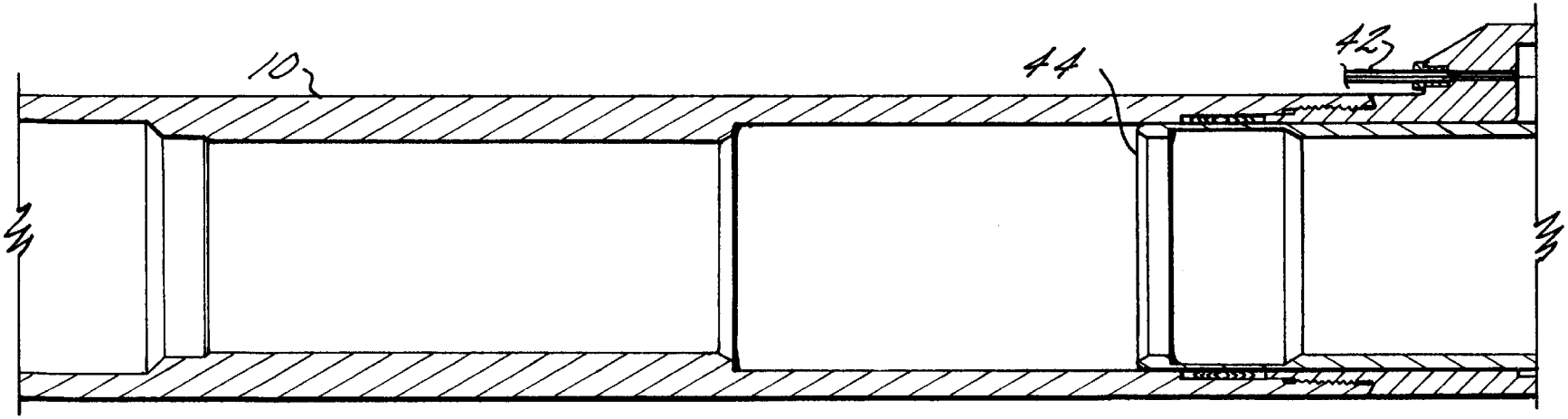
FIGS. 4–6 is a sequential cross section of the invention in an open position.
Figure 5:
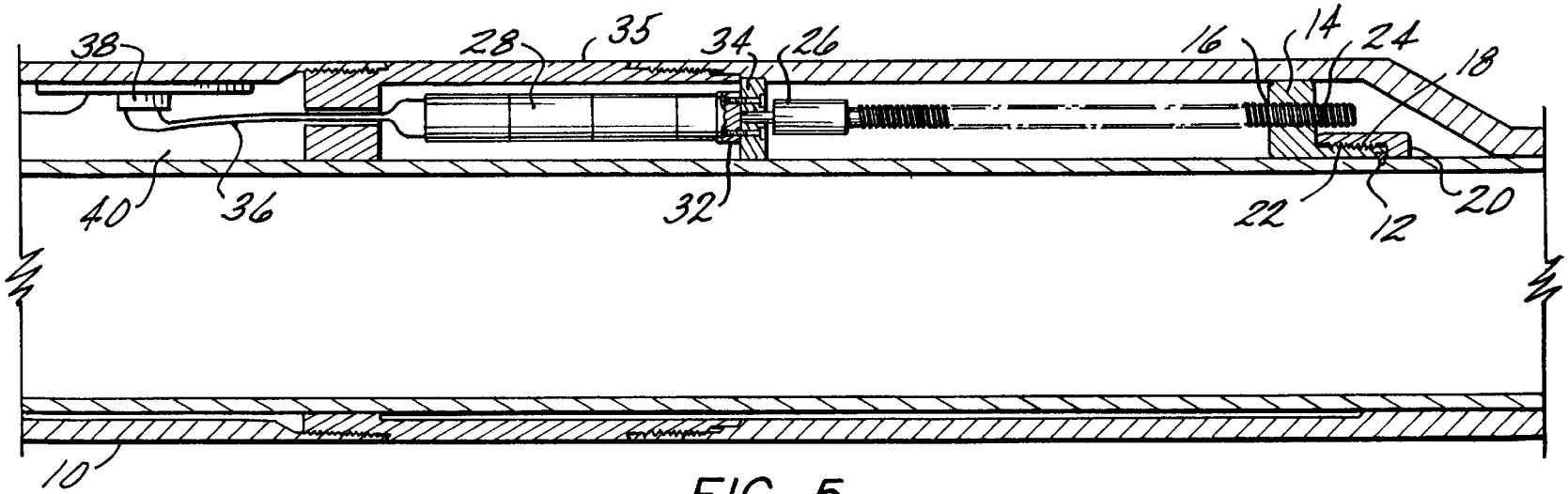
Figure 6:
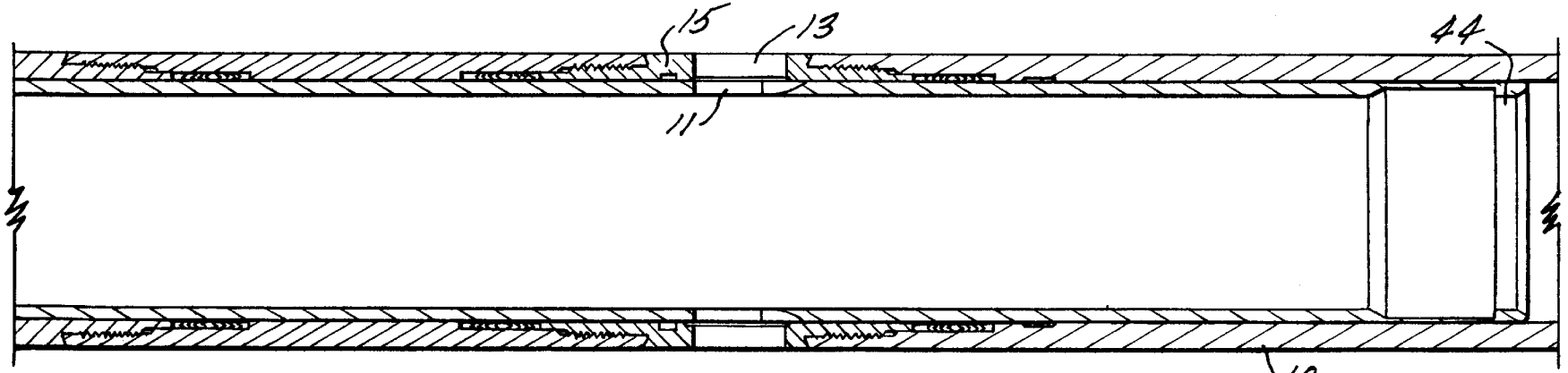
Figure 7:
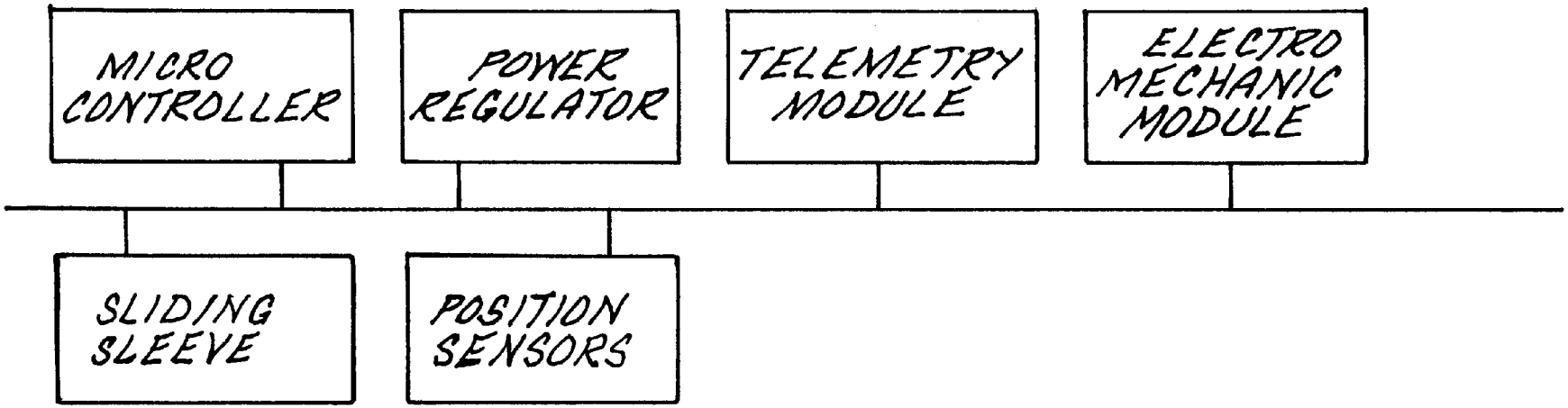
FIG. 7 is a chart of the electronic components for the example of the invention in use.

Threaded throughbore 16 is adapted for threaded engagement with lead screw 24. Lead screw 24 is elongated and is rotatably attached to motor 28 through coupling 26. It will be appreciated that coupling 26 may be of any type sufficient to rotatably bind lead screw 24 to shaft 30 of gear box 32 through which motor 28 transmits torque. In preferred arrangements a resolver is also attached to the moving members of the invention to determine position of the sleeve. It should be understood that motor 28 may actually be a plurality of electronic motors linked together in order to increase total torque output. Reversing polarity of motor 28, thus turning lead screw 24 in opposite directions causes sleeve attachment 14 to move uphole or downhole depending upon direction of screw 24 movement. The uphole or closed position is shown in FIGS. 1–3 and the downhole or open position in FIGS. 4–6.

As will be appreciated by one of skill in the art, the motor enables either a full open/full close operation or a metered open/metered close operation. This is accomplished by activating the motor in the desired direction only until a position sensor indicates that the sleeve is at a particular position. This information is transmitted to a logic circuit either downhole or at the surface and a decision is made as to whether or not the position of the closing sleeve is acceptable. Another embodiment employs a stepper motor so that activation thereof will only activate the motor for a stepped increment or a predetermined number of stepped increments. This provides excellent metered control over the sliding sleeve. With respect to the position sensor, one of skill in the art will recognize that any position sensor will be effective.

Adding support to the motor 28 and gear box 32 in the preferred embodiment is flange 34 through which gear shaft 30 extends. Flange 34 is fixedly connected to housing 35 of the invention.

Motor 28 is powered and receives commands via power line 36 connected to PCB 38 housed in atmospheric chamber 40. Energy is preferably provided to PCB 38 through TEC wire 42 from the surface or from a downhole battery or capacitor power source (not shown). In the event a capacitor source is desired, the preferred amount of energy stored would be enough to complete one whole cycle, from closed to open to closed.

In the event of a failure of any of the electrical actuation components, the sleeve may be conventionally actuated using a shifting tool on shifting profiles 44 which are known from the otherwise conventional sliding sleeve 46 commercially available from Baker Oil Tools, 6023 Navigation Boulevard, Houston, Tex. 77011. Operating the sleeve conventionally merely requires placing a load in tension or compression on the shifting profiles sufficient to uncouple the shear release 12 to separate the closing sleeve 10 from the sleeve attachment member 14 or shearing and releasing dogs as discussed hereinbelow. After release, the sliding sleeve operates in the manner heretofore common to the industry.

The employment of at least one position sensor is contemplated for the invention in order to provide such information to the surface or to a downhole intelligence package such as one of those disclosed in U.S. Ser. No. 08/385,992 field Feb. 9, 1995 by Baker Oil Tools the entire contents of which is incorporated herein by reference. It will be appreciated that the tools described herein are analogous to the downhole control devices referred to in the incorporated application. In connection with a downhole intelligence system the flow control device can be completely operated automatically downhole.

One preferred example of the tool of the invention with intelligent downhole components is composed of the following interconnected modules.

A microprocessor based control module is used for the acquisition of downhole information related to the location of the sleeve and status of the electrical motor used for the actuation of the sleeve. The module also interfaces with the telemetry system, and decode the commands transmitted from the surface. The module will be composed of a micro controller, which includes memory, analog to digital converter, input/output modules, a motor driver module to control the operation of the motor and a position sensor analog conditioner circuit used for interfacing the sleeve position sensors to the A/D converter.

A power Regulator converts the DC high voltage located on the cable into a voltage level that can be utilized by the motor for the actuation of the sleeve. The regulator can be a linear or switching device. This downhole application uses a switching device to provide a more efficient power conversion, to reduce the heat generated by the power supply, and to maintain a constant power delivered to the motor.

The telemetry module interfaces the downhole tool to the surface system through an electrical cable. The module will have a half duplex communications capability where only one device can send a signal on the cable at a time. The telemetry modules can be attached to the downhole cable in parallel permitting a number of sleeves to be addressed and actuated from the surface individually.

The electromechanical module is composed of a stepper motor, gear box, a follower nut, and a lead screw that controls the movement of the sleeve in the longitudinal axis of the tubing string. The motor is controlled by the microprocessor board which provides the necessary DC power and polarity for the proper operation of the motor. A gear box attached to the motor decreases the speed of actuation, but increases the torque which is necessary for the generation of sufficient force for the actuation of the sleeve. The follower nut and lead screw assembly interfaces the gear box to the sleeve, and allow the force generated by the gear box to be used for actuation of the sleeve.

The sliding sleeve is composed of a tubing that can be screwed in line to the production tubing with male threads on one end, and female threads on the other end. A preferred openings equivalent of about 1½ times the internal diameter of the tubing are located in the tubing to permit the fluids to flow from the formation to the inside of the tubing. It will be understood, however, that other ratios are selectable while maintaining desirable flow rates. For example, a 1:1 ratio of the openings equivalent is also acceptable. A sleeve located on the outside of the assembly covers the opening when in the closed position, and it exposes the opening to the formation when in the open position. The sleeve is attached to the follower nut and lead screw assembly located on the outside of the tool.

At least one position sensor is located in the sleeve and L.V.D.T. resolvers or linear potentiometers are mounted near the opening of the tool. The micro controller board monitors the position of the sleeve by sensing which sensor is being affected by the magnets.

For purposes of clarity, the operation of the sliding sleeve tool is described below:

The surface system asks for the location of the sleeve, and status of the entire system. The microprocessor decodes the command and returns, via TEC line to the surface, the tool status information. Each tool includes a unique electronic address that allows the surface system to interface with the particular sleeve.

The surface system commands the downhole tool to open the sleeve to initiate the production of the zone being controlled by the sleeve. To accomplish this result, the surface computer increases the DC voltage placed in the cable to allow enough power to be transmitted to the motor. It will be understood that while surface decisions are indicated here, this is merely exemplary and all decision and evaluation may be accomplished in and by the downhole electronics and processor package.

The microprocessor actuates the motor drivers to allow power to be placed at the motor for the generation of the mechanical motion required to drive the sliding sleeve.

The processor monitors the position of the sleeve through a position sensor and turns off the power to the motor once the sleeve has reached its predetermined or desired resting location.

Where a surface system is also employed, the surface system lowers the voltage levels upon detection of the low power consumption on the cable, and sends a message downhole inquiring about the status of the tool. The tool replies with the location of the sleeve.

Steps 1 through 5 can be repeated to close the sleeve. The only modification is that the command sent from the surface to the tool will be to close the sleeve instead of to open it.

The electronics are housed in an atmospheric pressure chamber located on the outside of the sliding sleeve tubing. The system is preferably rated to 15000 psi. and 150 degrees on the Celsius scale. The maximum actuation power generated by the electromechanical assembly is about 10,000 pounds. Equipment that has been in use for a period of time may require longer cycle times due to scaling and debris that may have accumulated over the service life of the tool.

Figure 9:
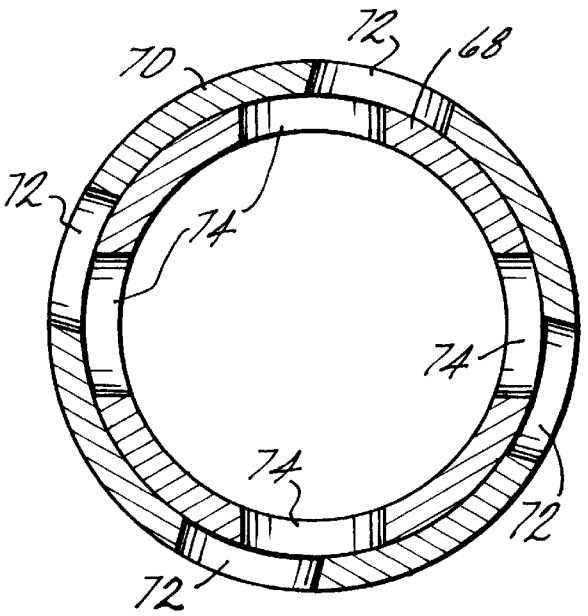
FIG. 9 is a cross sectional view of the invention illustrating the rotational layout of the rotating sleeve.
Figure 8:
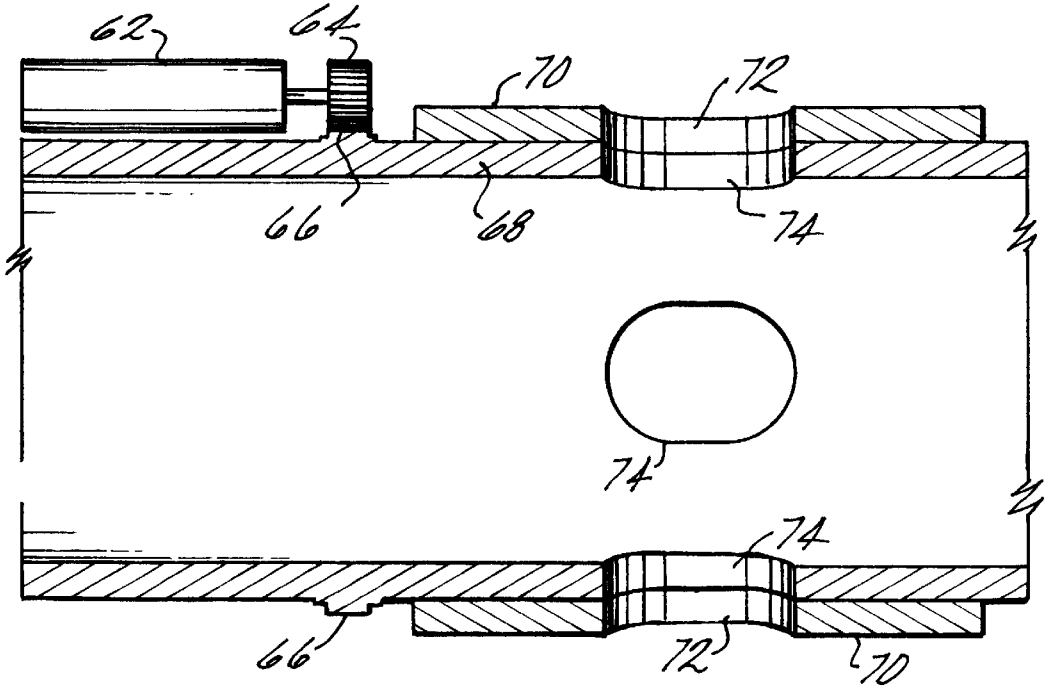
FIG. 8 is a longitudinal cross sectional view of the invention illustrating the motor and gear arrangement for the rotational embodiment of the invention.

In another embodiment of the invention, referring to FIGS. 8 and 9, a rotational sleeve 60 is employed as the flow control device instead of the axially sliding sleeve. Essentially the rotating sleeve functions in the same manner as the sliding sleeve, by alignment of the outer slots 72 with the internal slots 74 or misaligning the same slots but does so in a rotary manner instead of the axial manner of the conventional sliding sleeve. The rotary sleeve is operated by a motor 62 driving a gear 64 which meshes with teeth 66 on the insert 68. The rotational sleeve itself is very similar in function to a sliding sleeve but turns the inner sleeve to open, choke or close flow as desired. The outer sleeve is indicated by the numeral 70. As in the embodiment described above, the present device is responsive to commands from either a local downhole intelligence device or to a remote or surface input. Signals are carried by preferably TEC wire as more fully described above.

Figure 10:
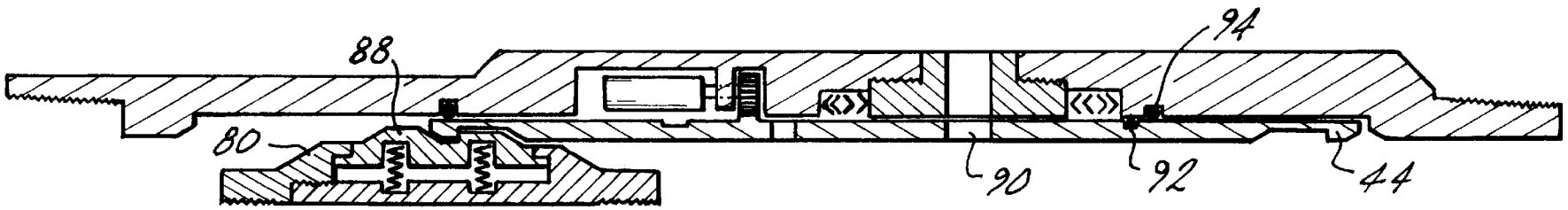
FIG. 10 is a longitudinal cross sectional view of the invention illustrating the contingency open position.
Figure 11:
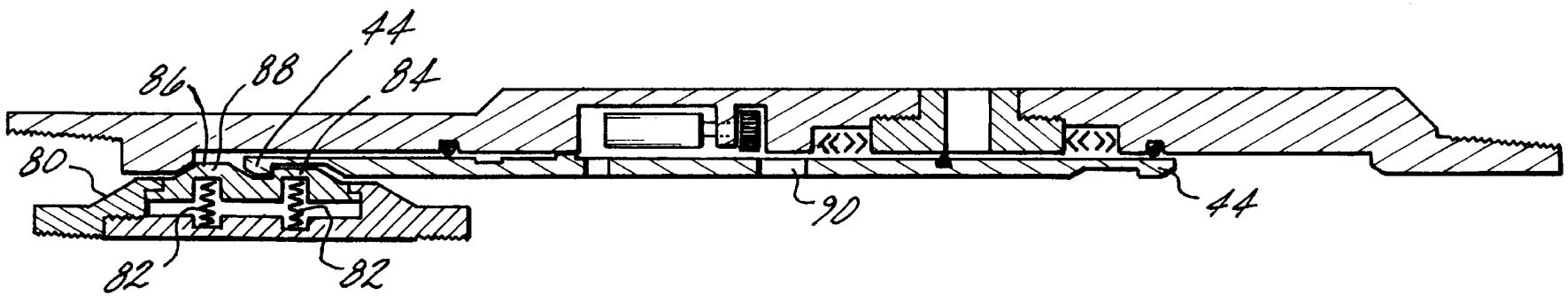
FIG. 11 is a longitudinal cross section view of the invention illustrating the contingency closed position.

The rotational embodiment provides much of the same advantages as the linear embodiment such as metered closing and opening with a high degree of accuracy. A regular motor using time and power parameters or a stepper motor may be utilized wherein the counts of the motor are used to determine the degree to which the sleeve is open or closed. While it is unlikely that the motor driven embodiment will fail it is nevertheless important in all oil well apparati to provide for a contingency in the event of a failure. Therefore and with respect to the rotational embodiment, illustrated in FIGS. 10 and 11 of the invention one contingency construction is to provide a specific key arrangement for opening or closing the sleeve by engaging the opening and closing features (shifting features 44) selectively. As is easily understood from the illustration in the identified FIGURES the shifting tool 80 includes springs 82 which bias a key 84 having a short key length 86 to close the flow device and a long key length 88 to open the device. It will be apparent from the drawings that for the contingency embodiment of the tool a second set of windows is required. Windows 90 are, in normal operation of the invention, downhole of the external windows of the outer sleeve and are not in communication therewith. Upon the need to contingently actuate the flow device, the window 90 can be shifted into communication with the external window. In order for the invention to function normally in a reliable manner, it is advisable to provide means to prevent the axial movement of the tool. This is most preferably a shear ring which is illustrated in FIG. 10 in the sheared position as 92 and 94. It will be understood that many other similar methods of holding the tool in the desired position are applicable and are within the scope of the invention.

Figure 15:
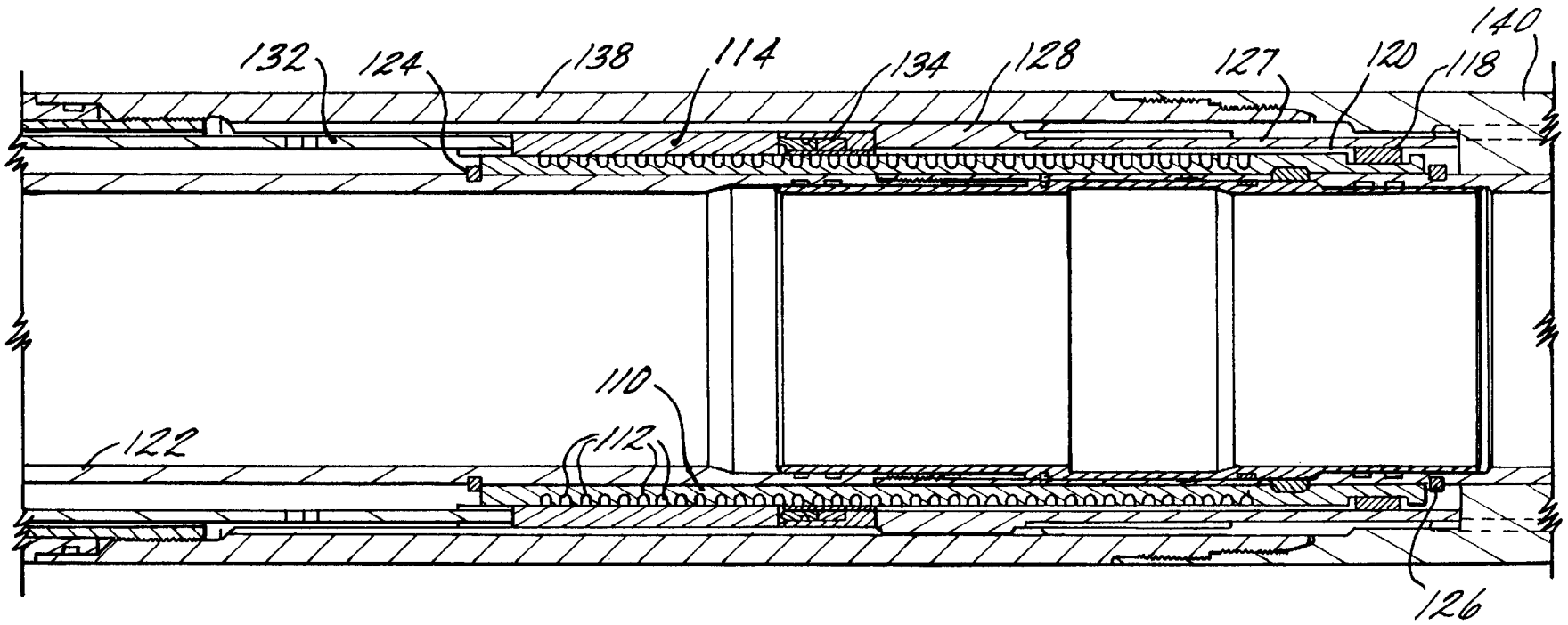
Figure 16:
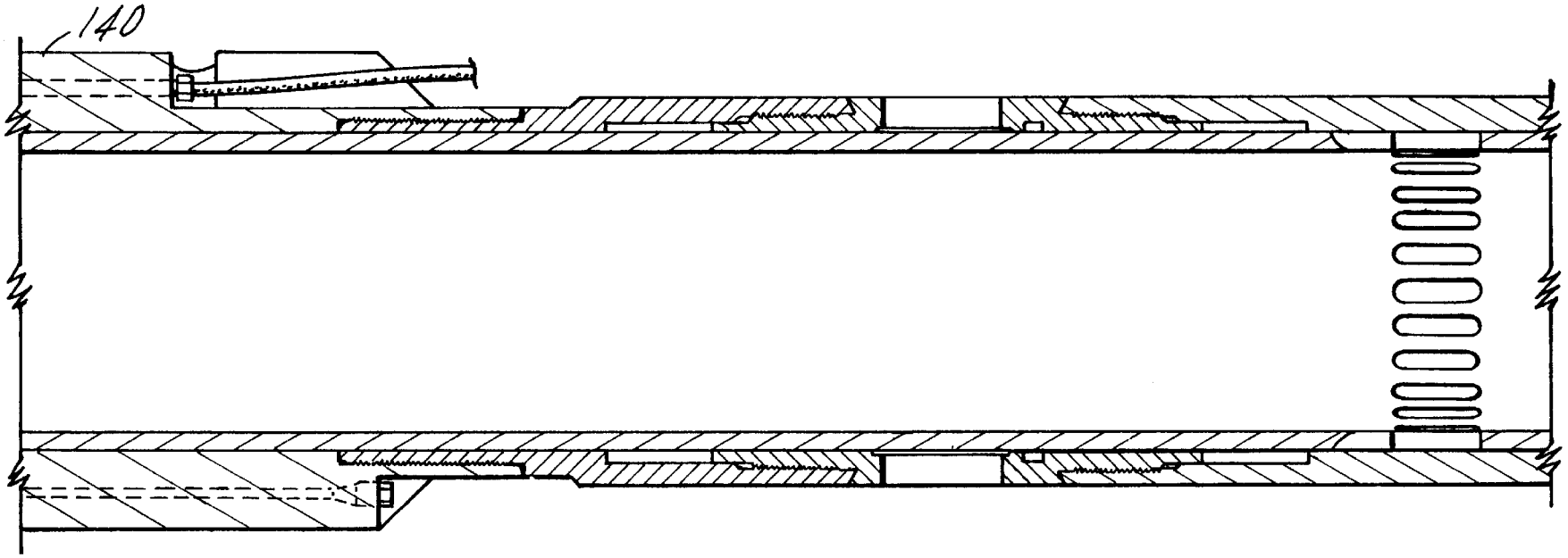
Figure 17:
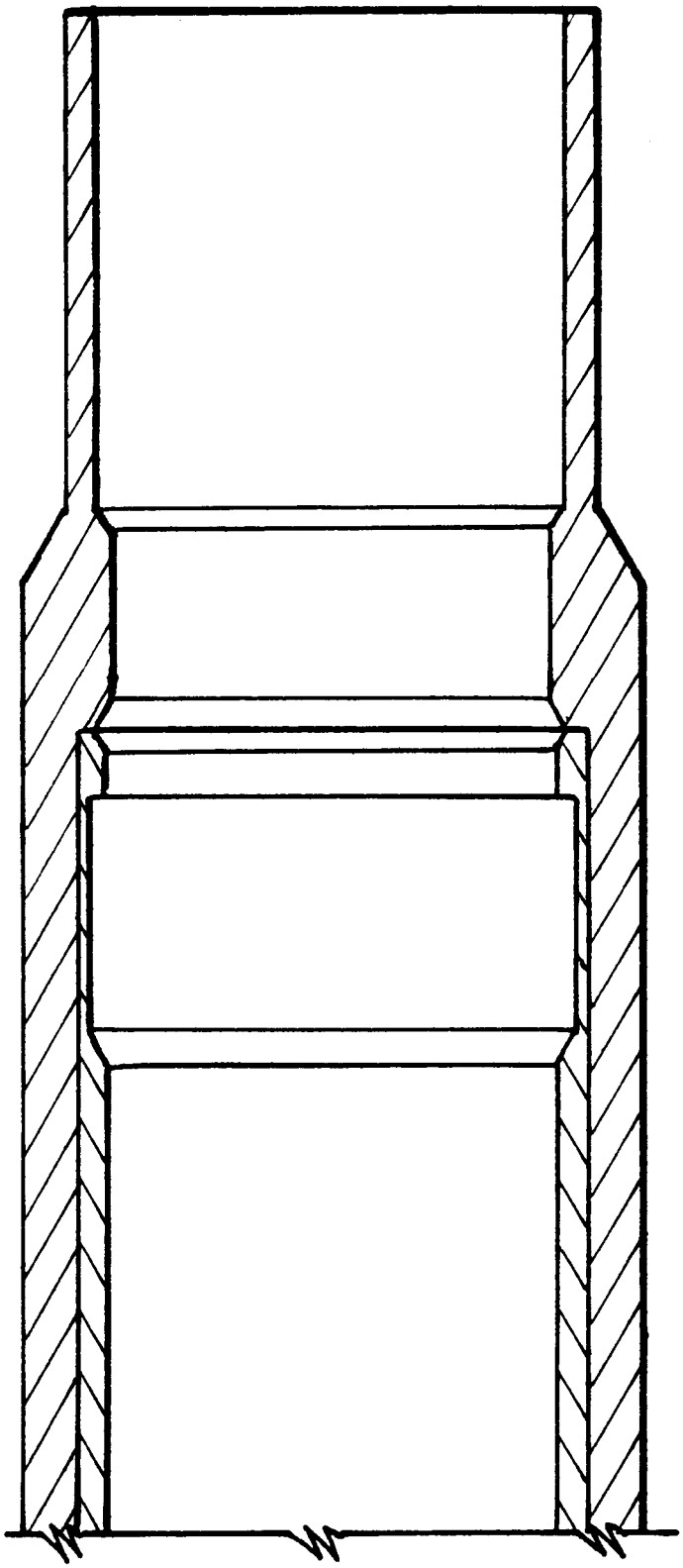
Figure 18:
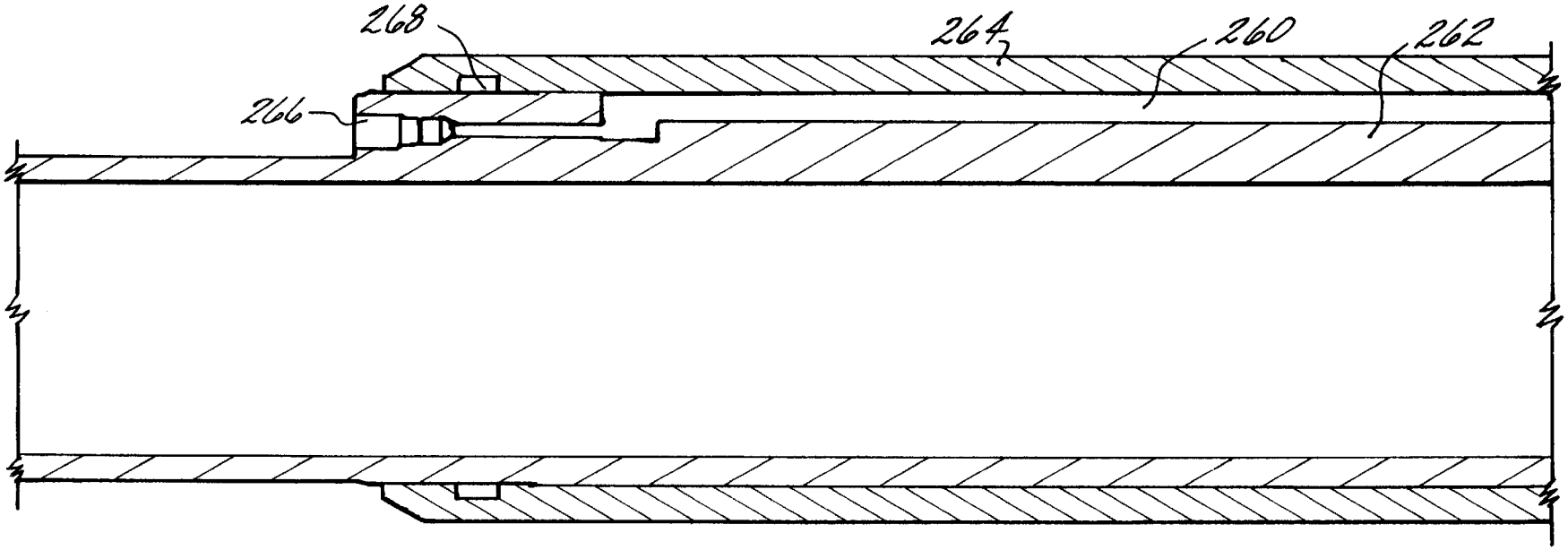
FIGS. 18–22 illustrate an extended view of a longitudinal cross section of an eccentric ball screw assembly actuator of the invention.
Figure 19:
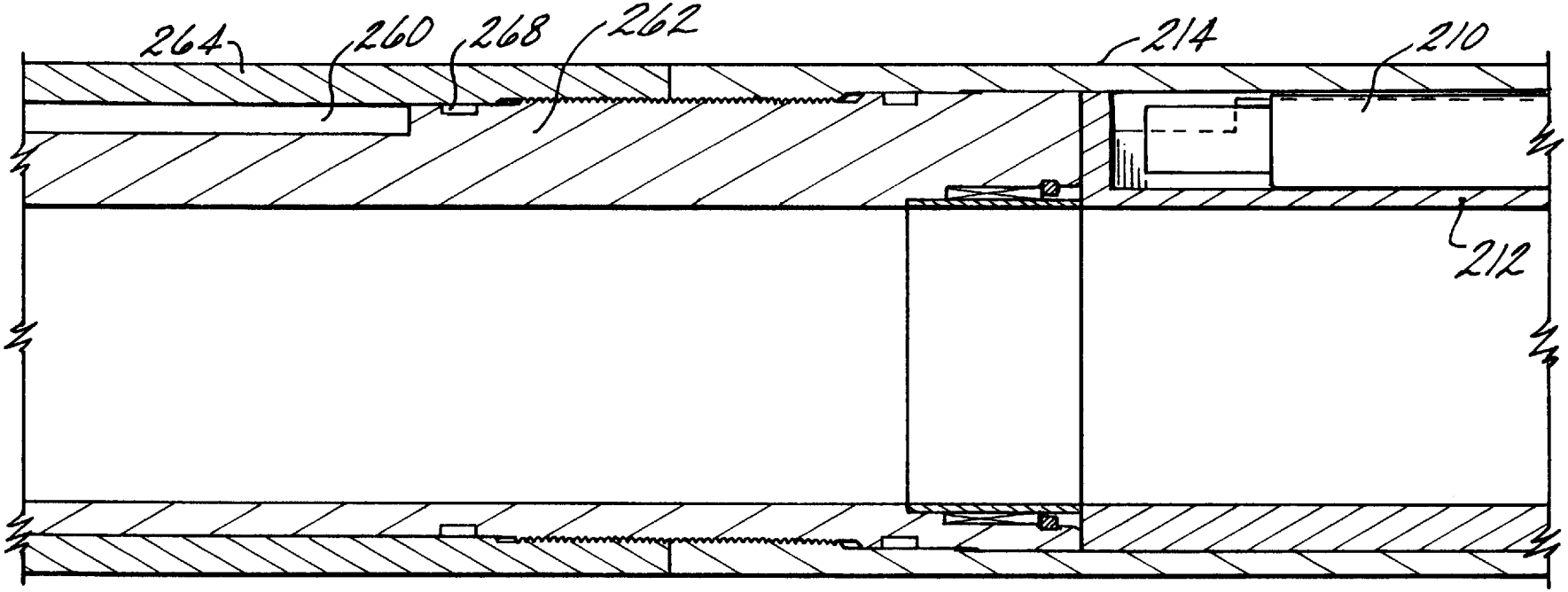

In the third embodiment of the invention, referring to FIGS. 12–16 a ball screw assembly is employed wherein the ball seat member is annular and circumferentially spans the production tube. The ball seat member is illustrated in FIG. 15 by numeral 110. Individual ball grooves 112, it will be understood, are actually a single helical groove similar to a screw thread. Ball seat member 110 is in operable communication with ball nut 114 which includes a plurality of ball bearings (not shown) that are received in ball grooves 112. Turning of ball nut 114 imparts a somewhat rotational and somewhat longitudinal force on member 110, however, key 118 which is fixedly connected to ball seat member 110 and locks member 110 into key way 120 of key sleeve 127 which is itself prevented from rotating by key 128 which extends into drive housing 138. The two key and keyway systems prevent any actual rotational movement of member 110. Therefore, all of the force transmitted to member 110 is translated to longitudinal motion of member 110. As one of ordinary skill in the art should appreciate, member 110 in drawing FIG. 15 is illustrated directly radially outward of a conventional sliding sleeve insert 122. Insert 122 is modified in that it includes ball seat snap rings 124 and 126 which act to prevent relative movement between ball seat member 110 and insert 122. It will be understood then that longitudinal movement of ball seat member 110 requires longitudinal movement of insert 122 to the same degree. Moving the insert uphole opens the sliding sleeve and moving the insert downhole closes the sliding sleeve.

The original rotational impetus of the invention is provided by an annular motor 130 which comprises an outer annular winding and an inner annular arrangement of permanent magnets. The winding is preferably mounted to the I.D. of an outer housing tube (i.e., motor housing 142). The magnets are mounted on an inner tube (i.e., the motor shaft 132). The most preferred magnets are samarium cobalt. The motor operates step wise with each powering of the coil. The motor shaft 132 extends to the interface with ball nut 114. Movement is transmitted from motor shaft 132 to ball nut 114 by a rabbet arrangement wherein each of the motor shaft 132 and the ball nut 114 are provided with a tooth or recess complimentary to that occurring on the other member and occurring approximately every ninety degrees. Ball nut 114 and motor shaft 132 are maintained in engagement with one another by thrust bearings 134 and 136. These are maintained in place respectively by key sleeve 127 and snap ring 129. The area is protected by drive housing 138. This is threadedly connected to TEC connector housing 140 at the downhole end thereof and to motor housing 142 at the uphole end thereof. Motor housing 142 is in turn connected to a turn buckle 144 which threads onto electronic sub 146.

The downhole processing center and electronics boards to signal and determine operation of the actuator are contained within atmosphere chamber 148 in electronic sub 146 and are covered hermetically by electronics cover 150. The downhole electronics enable the invention to compute such parameters as openness of the sleeve; flow rate; water cut; etc. and take corrective action with or without surface input. The electronics also closely monitor the position of the sliding sleeve by employing preferably a Resolver having a 360° position range. A resolver gear is meshed to a ring gear having a ratio sufficient to allow accurate indication of sleeve position. The arrangement is discussed further hereunder.

The motor and ball screw assembly are preferably maintained in a dielectric fluid to ensure cleanliness and long operational life. In order to maintain the fluid in these component areas metal spring energized seals are preferably employed. And while seals of this nature are highly reliable, balancing pressure across the seal is advisable to prevent substantial contamination by wellbore fluids.

In the most preferred embodiment of the invention, balancing of pressure between the production fluid and the dielectric fluid is accomplished by providing preferably five compensation cylinders 152 each of which contain a compensator piston 154. The preferred piston comprises a metal spring energized seal stack with an arlon seal cover (commercially available from Green Tweed) and separates the dielectric fluid on one side thereof from the wellbore fluid on the other side thereof. Each compensation cylinder 152 includes an inlet 156 to allow wellbore fluid from the inside of the production tube and thus the pressure associated therewith to flow into compensation cylinder 152 and thus force compensator piston 154 downhole whereby the pressure of the dielectric fluid in communication with the other side of the piston is increased. Since the dielectric fluid at the downhole side of the piston is contiguous with the fluid surrounding the drive components of the invention, and because the pressure across the piston is self equalizing, pressure on the seals separating the dielectric fluid from the environmental fluid is necessarily balanced. By allowing the pressure of the dielectric fluid around the working components of the invention to remain approximately equal to the pressure inside the production tube due to the compensation system, seal life is extended. In the most preferred embodiment of the invention, apertures 156 are drilled directly into compensation cylinders 152 as illustrated in FIG. 13A.

Figure 13:
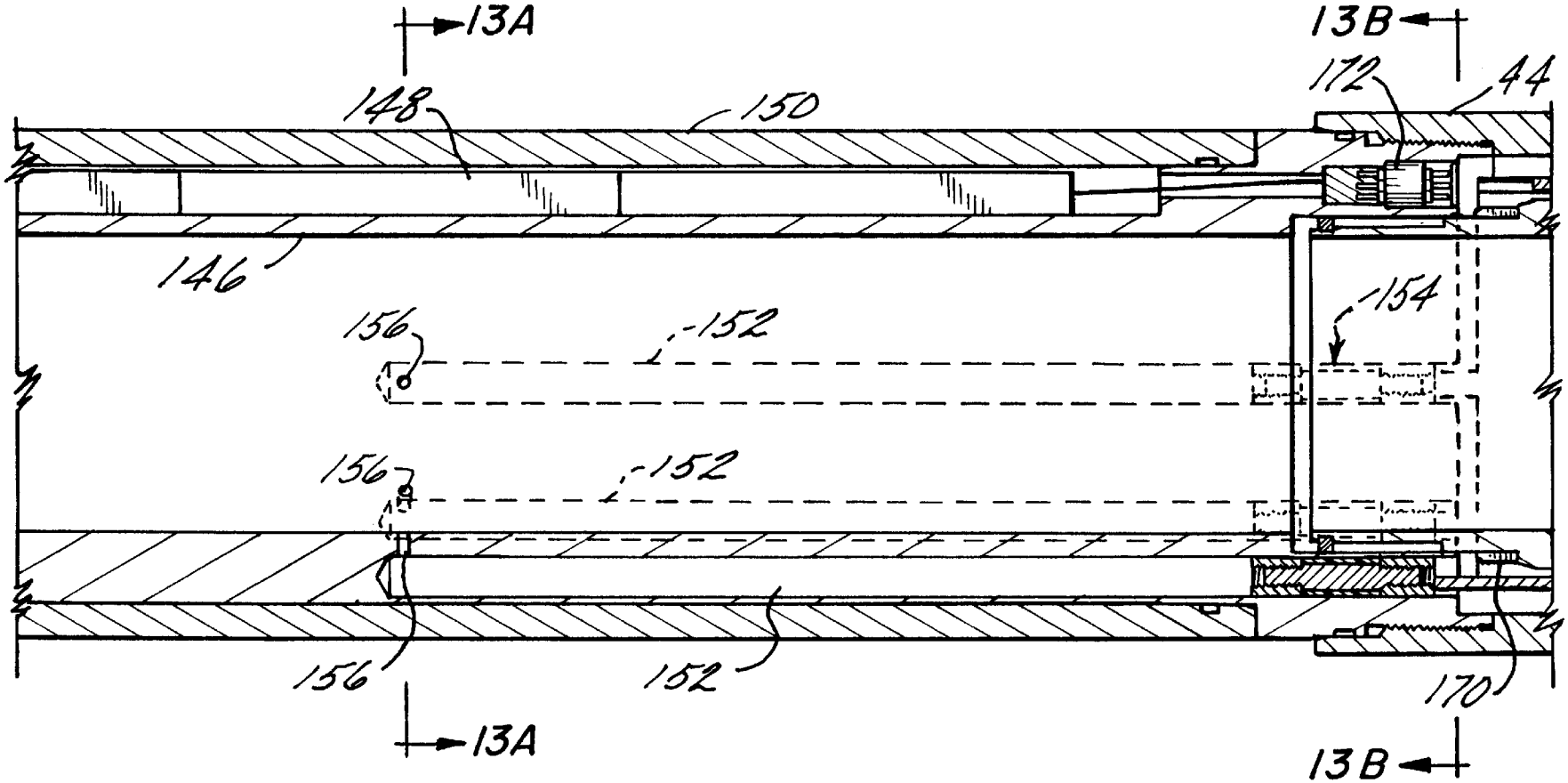
Figure 13B:
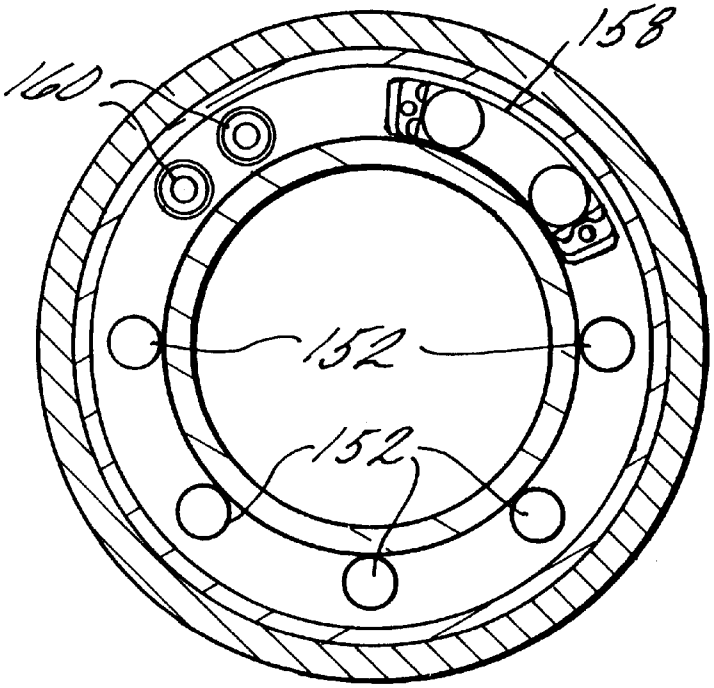
FIG. 13B illustrates a transverse section through FIG. 13 at section line 13B—13B.
Figure 13A:
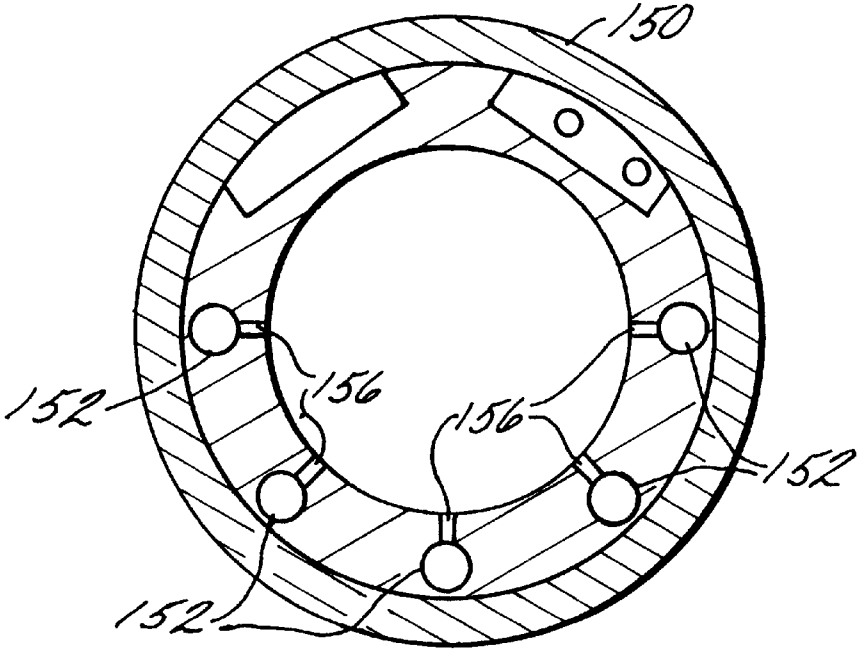
FIG. 13A illustrates a transverse section through FIG. 13 at section line 13A—13A.
Figure 14:
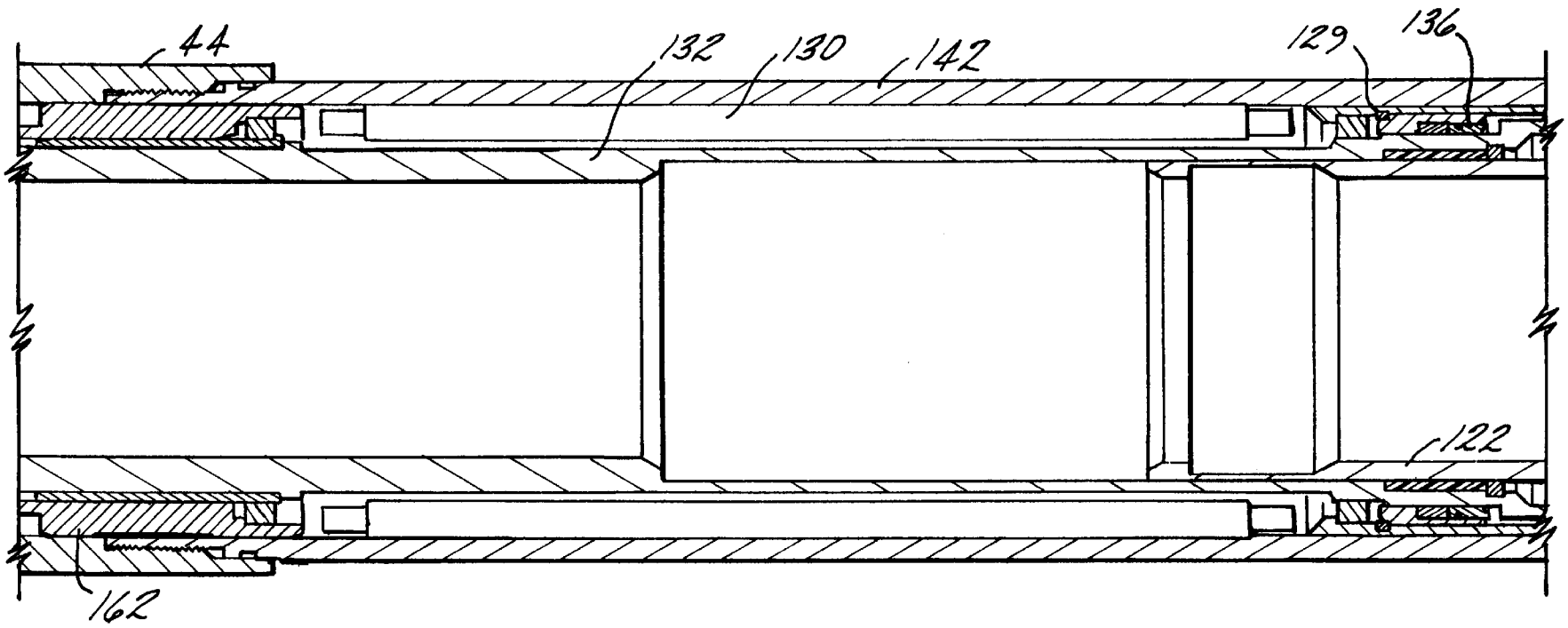

Referring to FIG. 13B, compensation cylinders 152 are visible in end view and compartment 158 is visible which houses the resolver and a synchro for the annular motor of the invention. Feed throughs 160 are also illustrated. The resolver of the present invention is intended to convey information from the ring gear to the downhole processor in the electronics package which translates the information to a number of inches of sleeve opening and transmits that information to the surface. This provides immediate and accurate information to the surface about the position of the sliding sleeve. The sleeve is optimally moveable through eight inches of stroke and, therefore, resolver 158 optimally employs a ratio of 256:1 with respect to ring gear 170 on the motor shaft. Three hundred and sixty degrees of rotation of the resolver most preferably equates to eight inches of stroke; thus the preferred ratio. By inputting a sinusoidal reference signal into the resolver from the electronics board a sine wave output signal and a cosine wave output signal are generated. A comparison between the reference signal and the output signal to determine in what quadrant the waves cross provides the necessary information to enable the downhole or other electronics calculate the angle between these signals. Subsequent to determining the angle between the signals the electronics will then calculate linear displacement of the tool with accuracy to within about ⅛". This information is transmitted uphole for monitoring and evaluation. For power feed through to the electronics 148, most preferably at least one multipin connector 172 is employed. In general these connectors may be employed anywhere in the invention where the TEC wire enters or exits the interior of the tool and at the beginning and end thereof to provide power to tools lower in the wellbore.

In order to prevent pistons 154 from extending beyond the ends of compensation cylinders 152, a piston retainer 162 is positioned with five fingers extending toward each of the five compensative pistons 154 and ending in position sufficient to prevent the escape of compensator pistons 154 from compensation cylinders 152. As will be appreciated, any number of fingers, pistons and cylinders are possible as desired. Five is merely preferred.

In a fourth embodiment of the invention, referring to FIGS. 18–22, a smaller diameter ball screw assembly is mounted eccentrically within a housing and operates through a connecting shaft against a drive yoke to actuate, via a shear out member, the insert of an otherwise conventional sliding sleeve. One of ordinary skill in the art will appreciate that the drive unit 210 (referring to FIGS. 19 and 20) includes a motor and a ball screw assembly which is not independently illustrated. The ball screw assembly is conventional and is commercially available from Astro Instruments Corp. The drive unit is contained in a compartment filled with dielectric fluid the compartment being defined by motor housing 212 and motor cover 214. Motor cover 214 is threadedly connected to the yoke housing 216 which is, in turn, connected to the conventional sliding sleeve (available commercially from Baker Oil Tools in Houston, Tex.) to provide a unified structure within which the drive yoke 220 may pass to actuate the insert 240. Drive yoke 220 is connected to insert 240 via a shear out structure 222. Structure 222 provides the connection to insert 240 via a plurality of, and preferably five, dogs 224 (see FIG. 21A). The dogs facilitate transition of movement without weighting any of the shear out screws 226 (which screws preferably number 10) during normal operation of the tool the shear out structure itself will be discussed subsequently.

Drive yoke 220 is coupled to the drive unit 210 via a connecting shaft 250 which extends or retracts depending upon the polarity of power fed to the drive unit motor which then actuates the conventional ball screw assembly in the appropriate direction. The uphole end of motor housing 212 is supplied with power connectors 266 (see FIGS. 18 and 19A) and is adjacent electronics housing 262. In the most preferred embodiment of the invention a space of not more than ⅛" is provided at the joint 263 between motor housing 212 and electronics housing 262 because motor cover threads 265 and yoke housing threads 267 are mated simultaneously. This requires either play within the tool or a timed thread cutting operation which is generally prohibitively expensive. Tie inventors hereof therefore prefer to allow the stated amount of play in the tool. Moreover, shoulder 269 is preferred for manufacture of the tool in order to reduce friction of the motor cover 214 against MSE seal 268. In other words cover 214 is machined to a lesser thickness until just downhole of the intended sealing surface for MSE 268. As the tool is made up, the cover 214 slides easily over the MSE seal until it is almost completely engaged. At this point the sealing surface area provides a much higher degree of friction on the seal. This machining results in shoulder 269 which is illustrated in the drawing FIGURE. The atmospheric chamber 260 encloses the downhole electronics and processing components and is hermetically sealed by electronics cover 264. The electronics perform the evaluation tasks and supply power to drive unit 210 in motor housing 212. The electronics are preferably supplied by TEC wire for which a connector 266 is sealed within the end of electronics housing 262. Information from the surface and from downhole sensors, including a position sensor, is processed downhole resulting in a determination regarding any necessary change in the sleeve and appropriate actuation thereof if necessary by delivery of a particular polarity of power being delivered to the motor of drive unit 210. Assisting the sealing of the atmospheric chamber by electronics cover 264 is most preferably a pair of MSE (metal spring energized) seals 268 or welded connections. Motor housing 212 is attached to the yoke housing 216 in the vicinity of the downhole extent of connecting shaft 250 as illustrated. In the most preferred embodiment of the invention there are bolts/alignment pins 271 (see FIG. 21C) that join the motor housing to the yoke housing and prevent the motor housing from moving relative to the yoke housing. A spacer 270 is inserted at the joint line between motor housing 212 and yoke housing 216, said spacer having projections 272 to maintain seals 274 within the respective gland areas.

Figure 20:
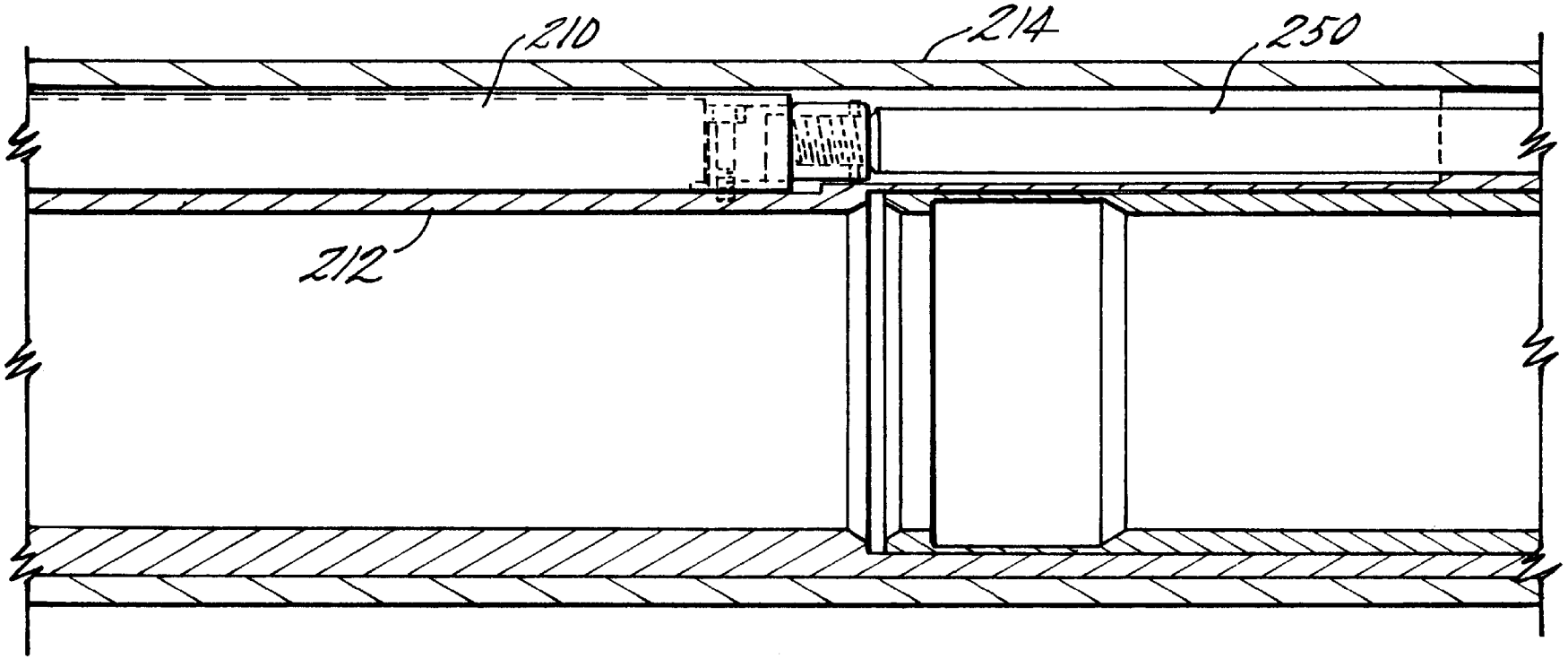
Figure 21:
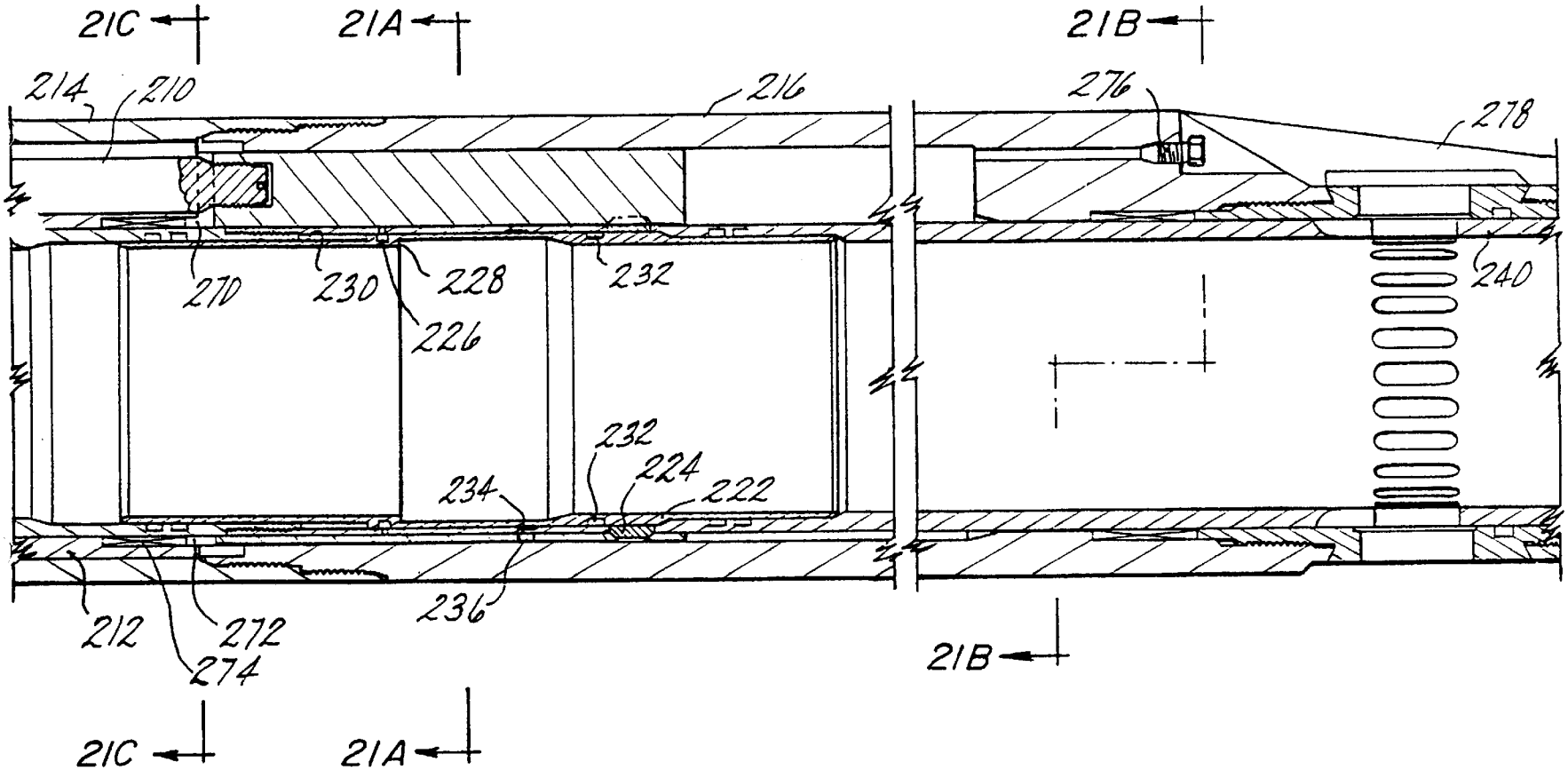
Figure 21A:
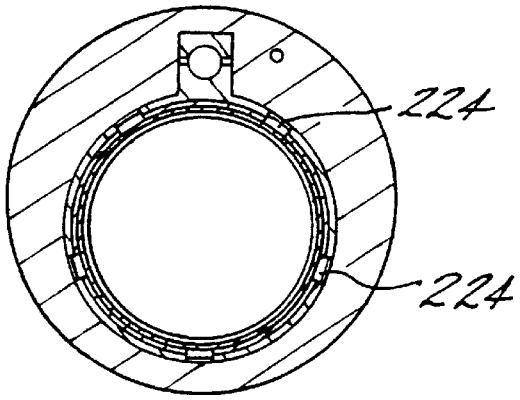
FIG. 21A is a cross section view of FIG. 21 taken along section lines 21A—21A.
Figure 21B:
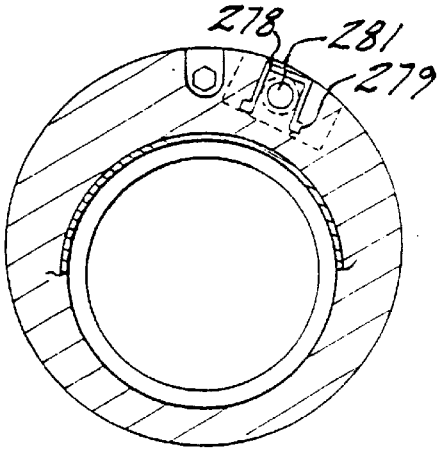
FIG. 21B is a cross section view of FIG. 21 taken along section lines 21B—21B.
Figure 21C:
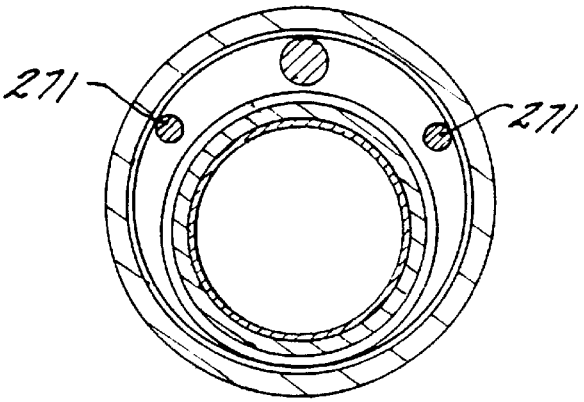
FIG. 21C is a cross section view of FIG. 21 taken along section lines 21C—21C.
Figure 22:
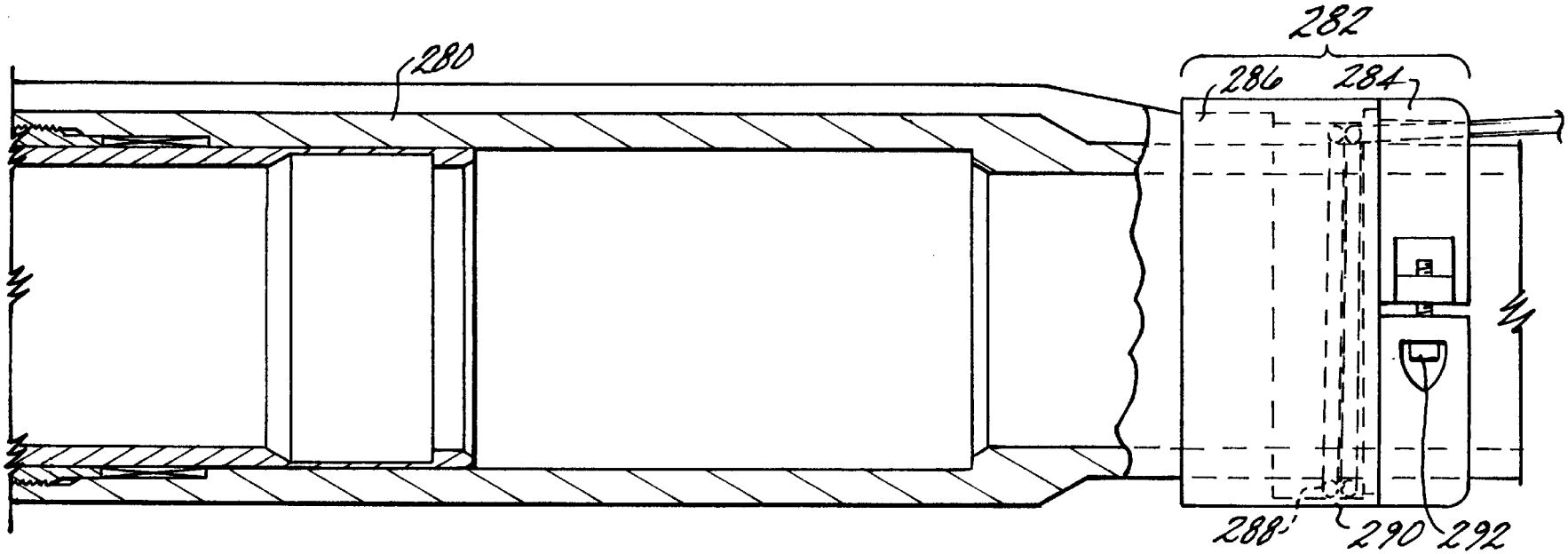
Figure 23:
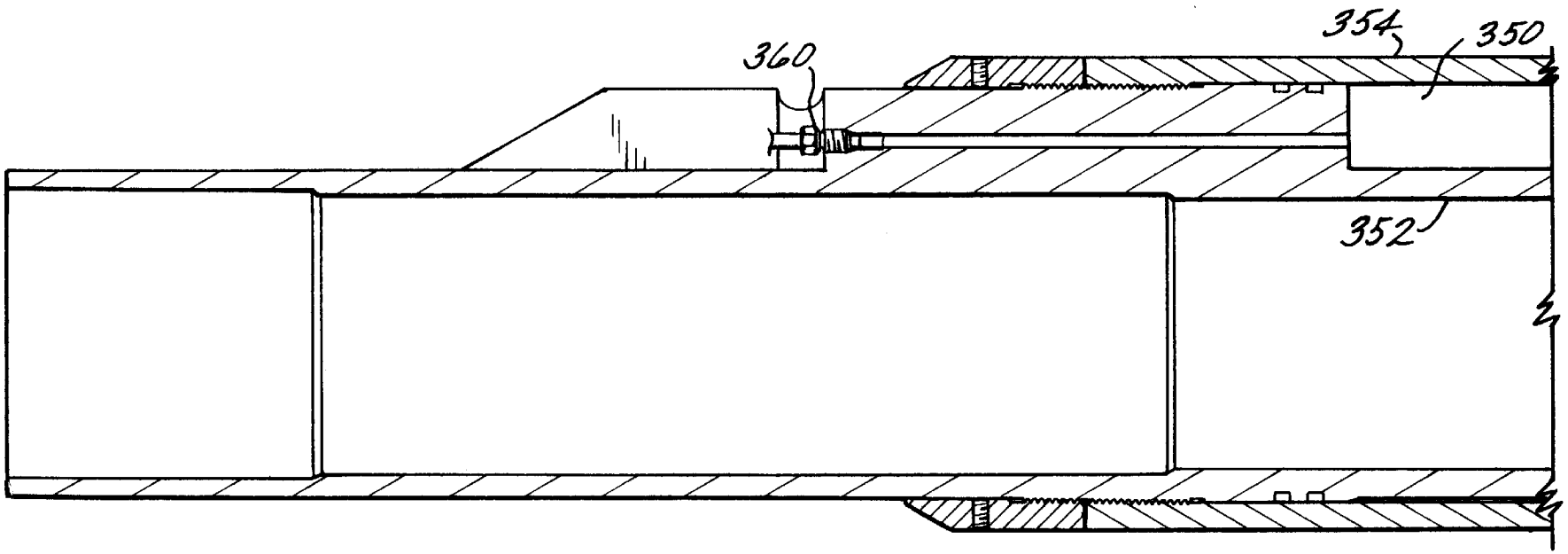
FIGS. 23–28 illustrate an extended view of an annular lead screw assembly actuator of the invention.
Figure 24:
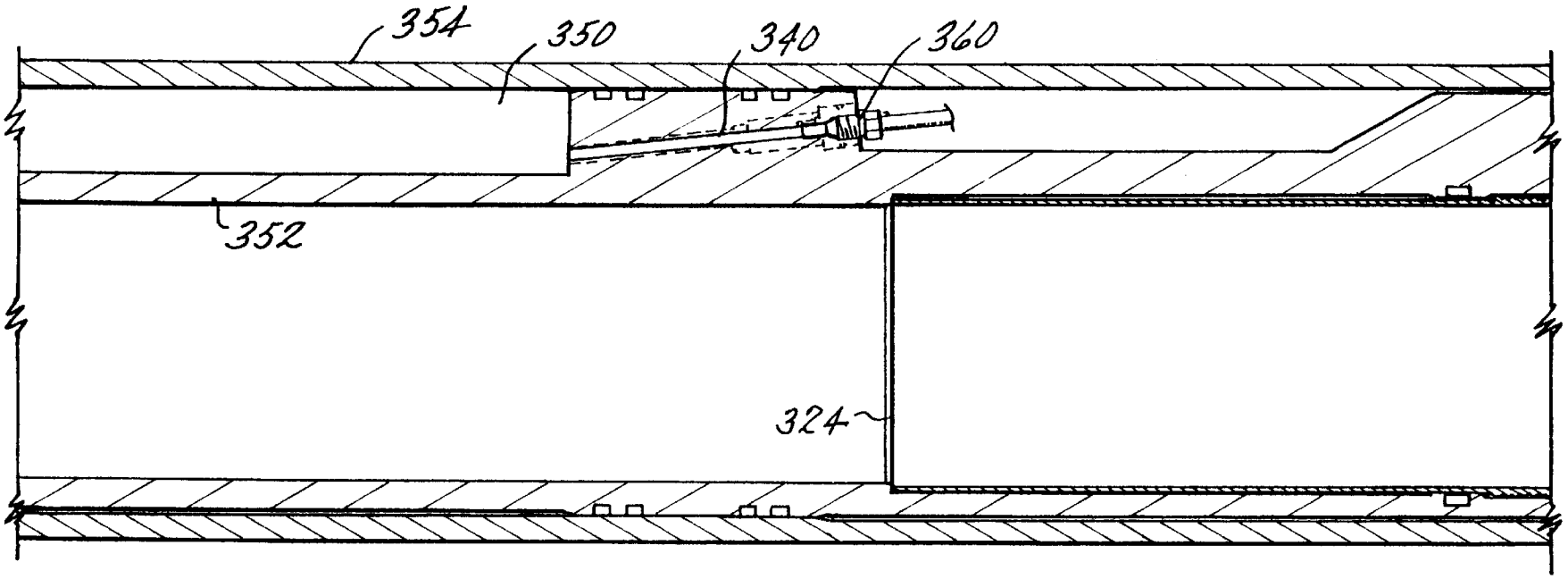
Figure 25:
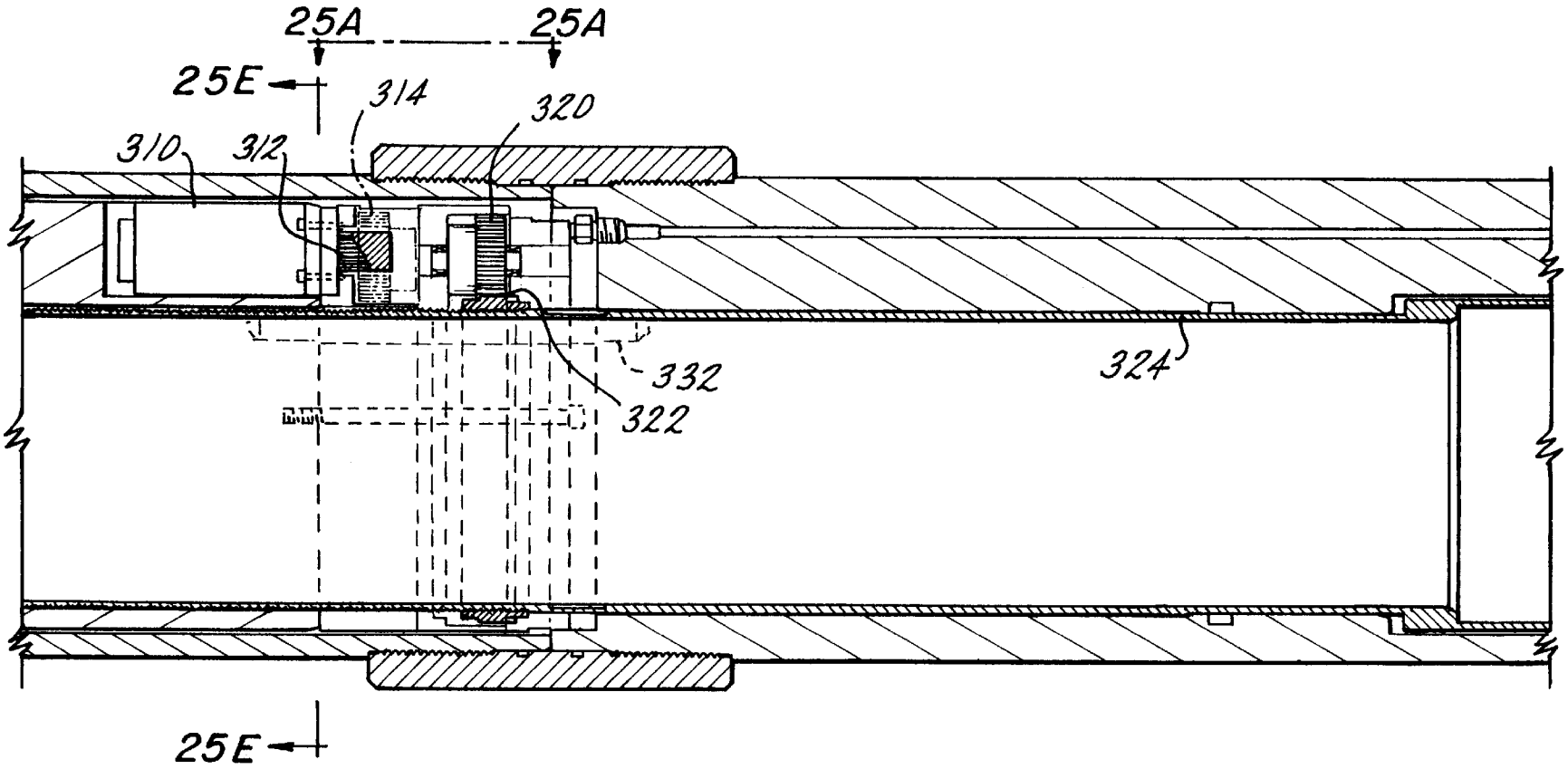

Referring to FIGS. 20, 21 and 21B, one of skill in the art will recognize TEC connector 276 leading to an exterior TEC wire (not shown). Conventionally, such wires have been run external to the tool down to the next tool for which power is require. In order to further advance the present invention a cover 278 is engaged with the sliding sleeve via wings 279 and provides a passage through which the TEC wire shown in this view as numeral 281 can pass while protecting the same from environmental impact. Cover 278 extends along the extent of lower sub 280 generally comprising the conventional sliding sleeve. Cover 278 is further maintained in contact with lower sub 280 by collar assembly 282. Collar assembly 282 comprises wire lock 284 and wire cover 286. Wire lock 284 provides a radiused inlet such that TEC wire 288 is not kinked upon bending ninety degrees prior to being coiled around the O.D. of the lower sub 280. TEC wire 288 is preferably coiled for several revolutions in order to provide additional wire slack so that making up the connection in the field will not require excessively tight measurement tolerances. To protect this wire, wire cover 286 is engaged around lower sub 280 in such a manner that extension 290 covers the coiled wire 288 to protect it from environmental impact. Wire cover 286 also extends over cover 278 to maintain it against lower sub 280. It will be appreciated from FIG. 22 that the wire lock 284 is in a generally conventional collar design having a hinge which is not shown and is approximately one hundred eighty degrees away from bolt 292 which when threaded into wire lock 284 secures the same to lower sub 280. Wire cover 286 operates in the same manner and further explanation is therefore deemed unnecessary.

In the unlikely event of an actuator failure, the sliding sleeve can be actuated conventionally with a prior art shifting tool once the actuator of the invention is disconnected from the sliding sleeve insert. To facilitate this end, the shear out structure of the invention is operated. The shear out member 222 includes shoulder 228 which is employed only when the drive unit of the invention has failed and it is required to move the shear out structure so that conventional shifting tools may be employed to operate the sliding sleeve. Shoulder 228 is beared upon by a shifting tool, which is conventional in the art, to shift the structure 222 uphole. A stroke length is provided by space 230 to provide sufficient room for shear out 222 to move uphole and allow dog 224 to slip radially inwardly out of engagement with drive yoke 220. A snap ring 232 is provided to prevent shear out 222 from moving downhole after it has been sheared. This is important because if the shear out structure 222 moves back downhole, it can reintroduce dog 224 to drive yoke 220. This defeats the operation of the structure 222 and prevents operation of the sliding sleeve by conventional shifting tools and techniques. Snap ring 232, upon uphole urging of shear out 222 will expand into annular groove 234 thus preventing the subsequent downhole movement of shear out 222. It is noted that in the most preferred embodiment of the invention, for manufacturing purposes, an assembly bore 236 is provided whereby snap ring 232 may be forced into shear out 222 and out of engagement with annular groove 234 in order to set the shear out 222 during manufacture. It should be noted that his shear out structure is employable with each of the actuator tools of the invention.

Figure 30:
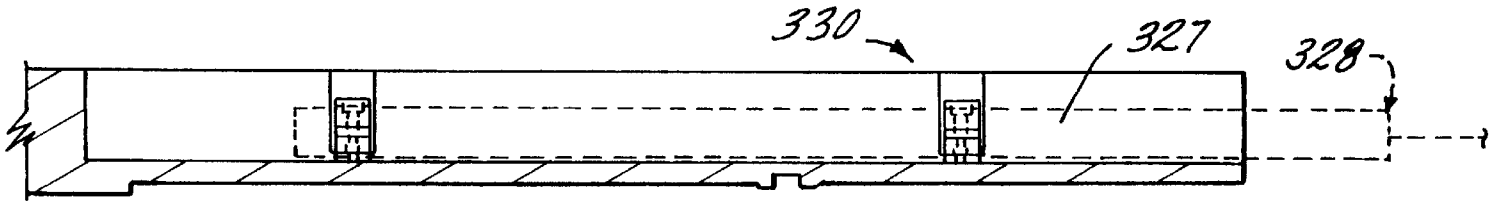
FIG. 30 is a radial section view of FIG. 25E taken along section line 30—30.
Figure 25E:
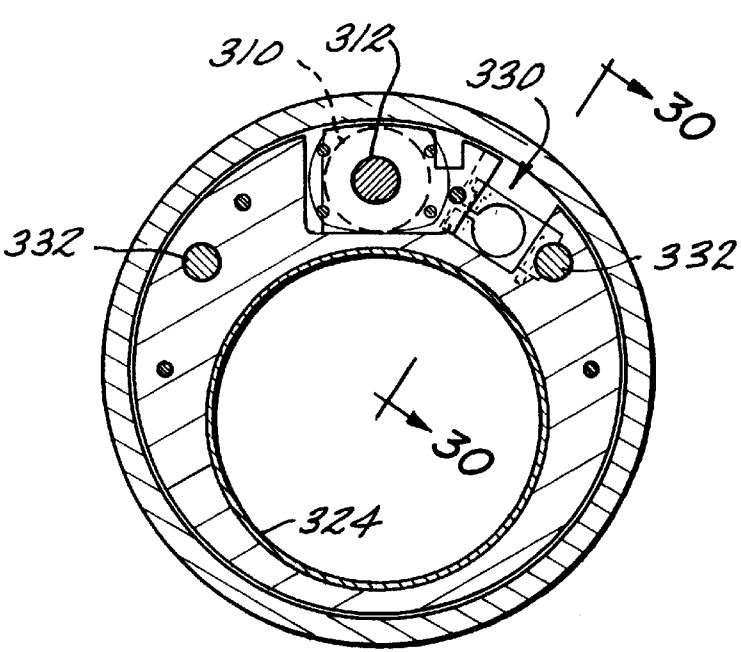
FIG. 25E is a cross section view of the invention of FIGS. 23–28 taken along section line 25E—25E.
Figure 25D:
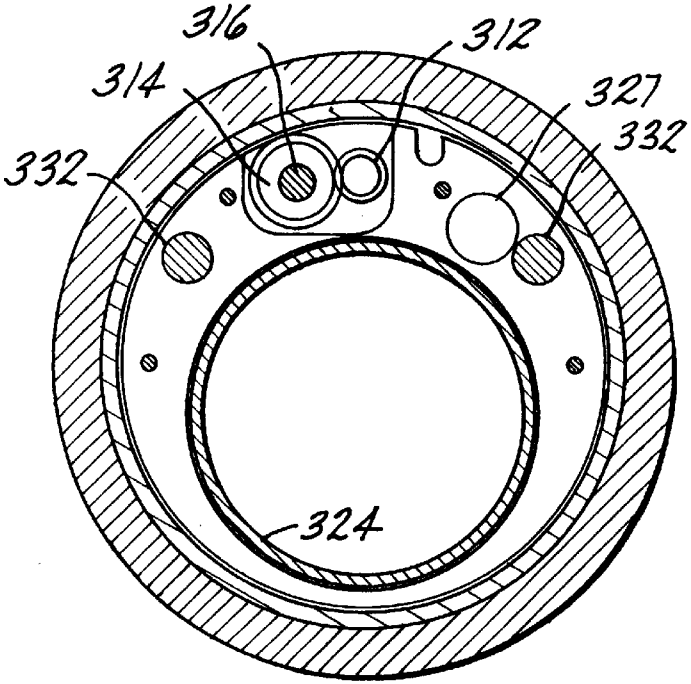
FIG. 25D is a cross section view of FIG. 25A taken along section line 25D—25D.
Figure 26:
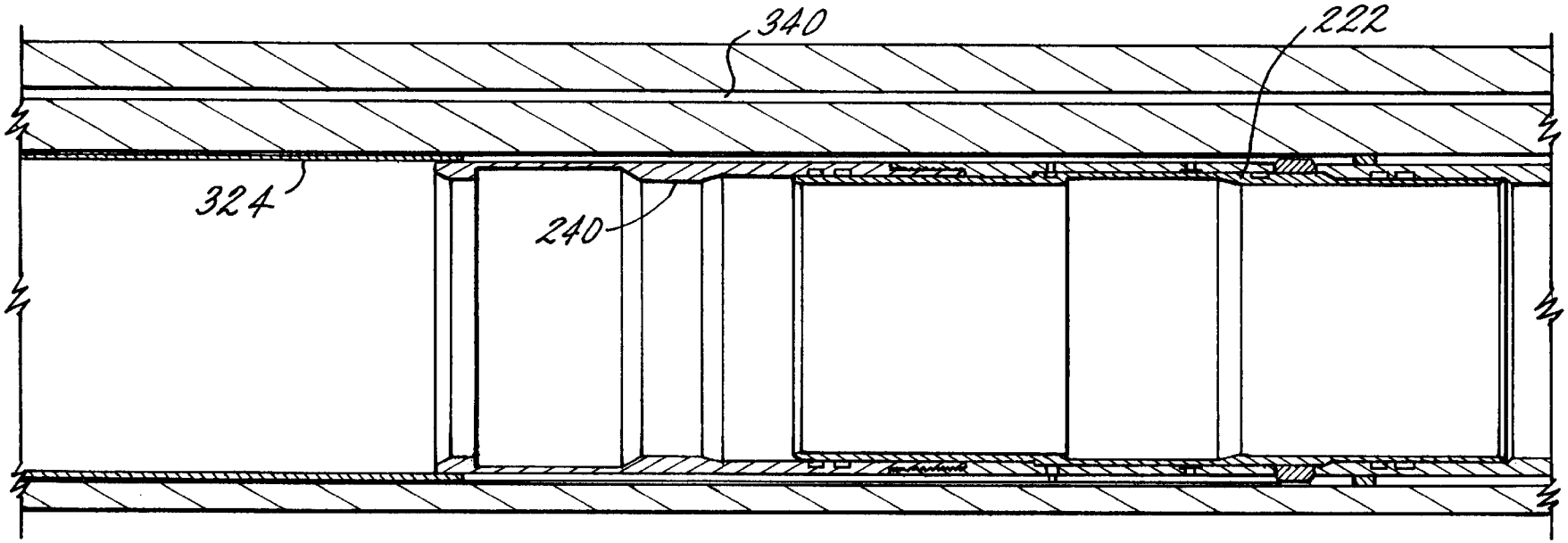
Figure 27:
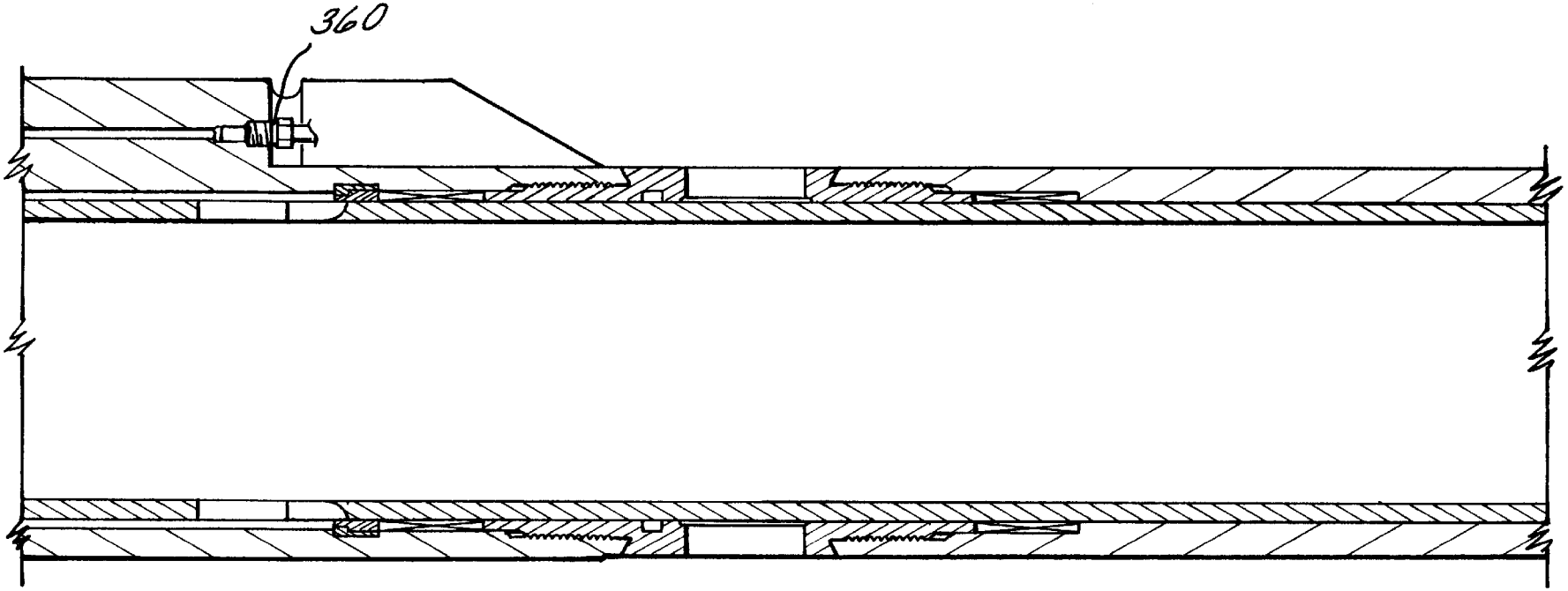
Figure 28:
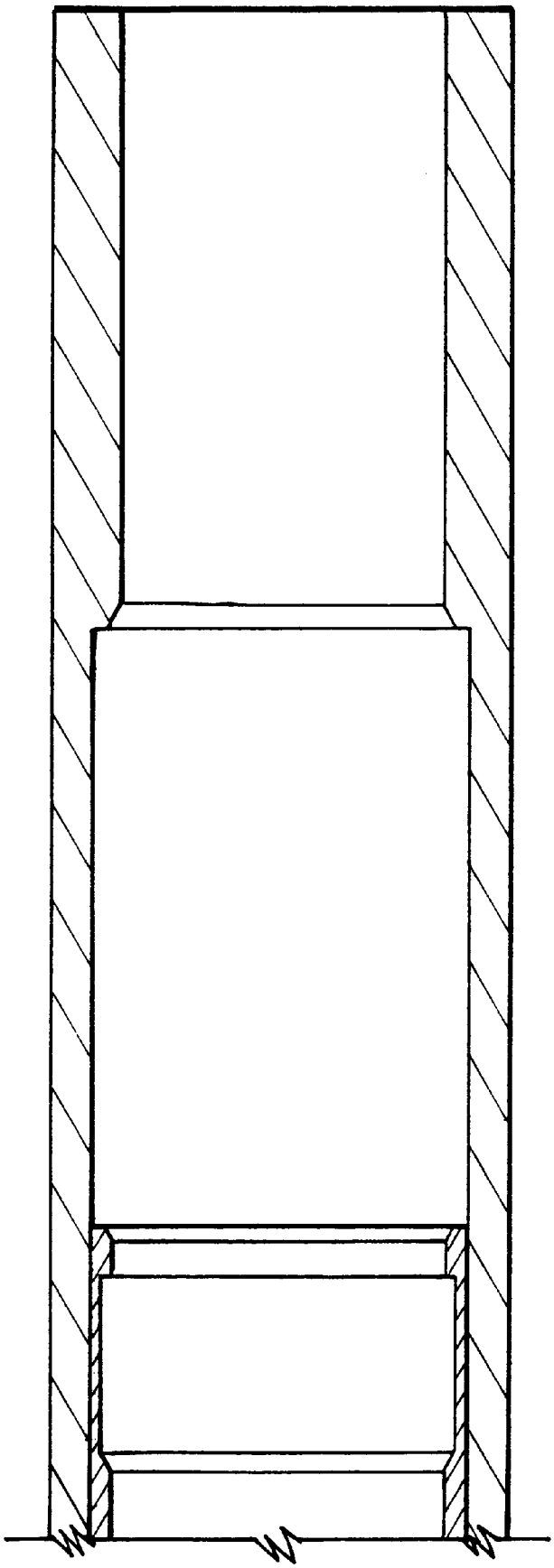
Figure 29:
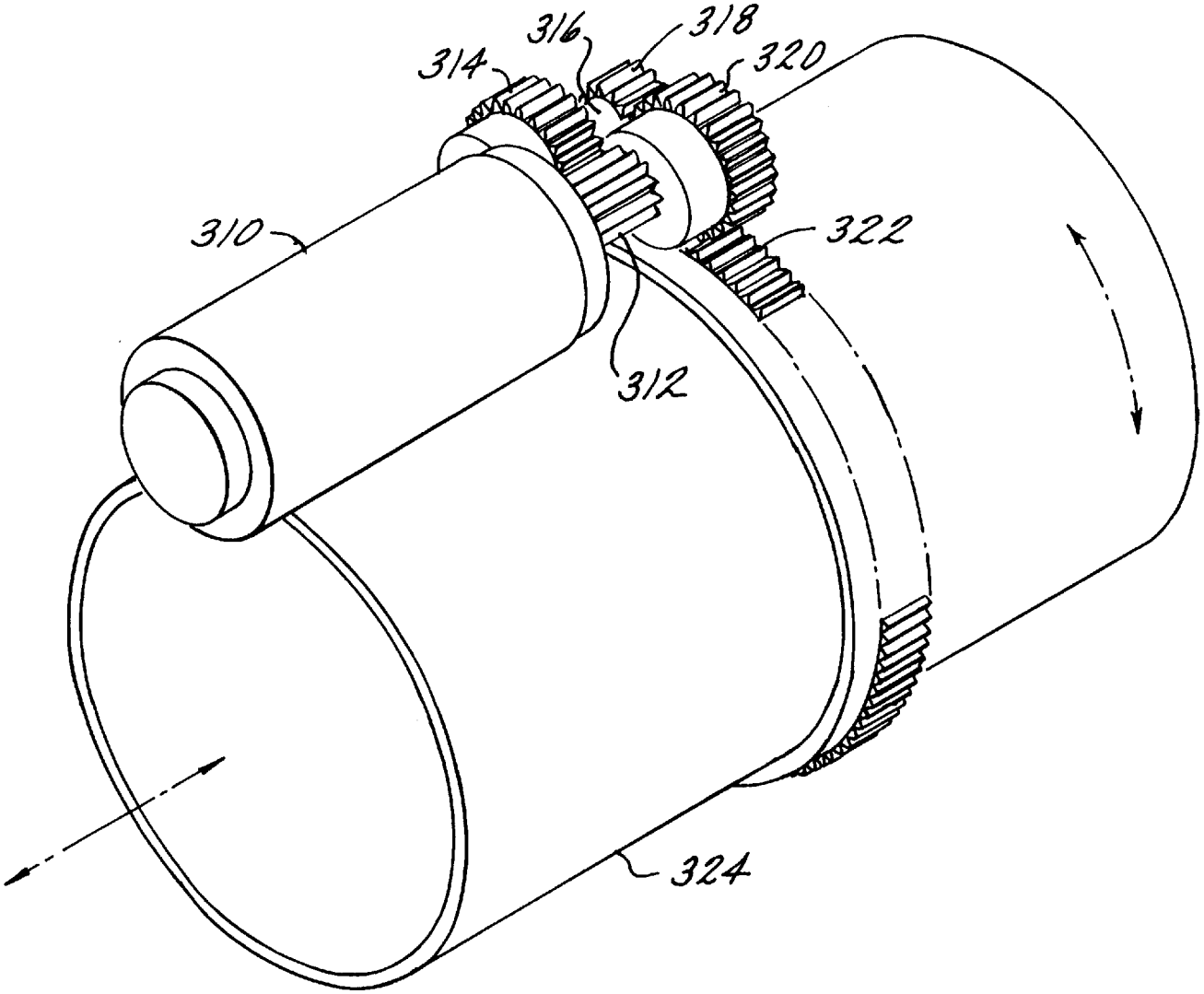
FIG. 29 is a schematic perspective illustration of the motor, gear train and actuator sleeve of the embodiment of FIGS. 23–28.

In a fifth embodiment of the invention, referring to FIGS. 23–30, a conventional sliding sleeve is actuated by a motor and gear train combination powering a lead screw which is connected through a shear release mechanism, identical to that discussed hereinabove, to the insert of an otherwise conventional sliding sleeve. Referring first to FIG. 29, a perspective schematic view of the motor gear train and lead screw of the invention is illustrated. A brief perusal of the figure will provide a detailed understanding of the motor gear drive and lead screw gear to one of ordinary skill in the art. Motor 310 includes a motor pinion 312 which meshes with follower gear 314 which is mounted on auxiliary shaft 316 and, therefore, mated without relative rotation to auxiliary gear 318. Gear 318 meshes with lead screw drive gear 320 which, in turn, drives lead screw gear 322. Lead screw gear 322 includes threads cut on the I.D. thereof of the same TPI as threads cut on the O.D. of actuator sleeve 324 (which is a flow tube). Therefore, by powering motor 310 in one direction or the other based upon polarity, the actuator sleeve 324 is driven uphole or downhole by the threads thereon. While actuator sleeve 324 would prefer to turn rotationally as opposed to move longitudinally, following the path of least resistance, sleeve 324 is provided with a key (visible in FIG. 25B as numeral 329) attached to the end of 328 of linear potentiometer 330. Referring to FIGS. 25E and 30, one of ordinary skill in the art will appreciate the preferred location of linear potentiometer 330 with respect to other components of the invention. Also illustrated well in FIG. 25E are alignment dowels 332 which assists in maintaining the several components of the invention relative to one another. Actuator sleeve 324 continues on to FIG. 26 wherein it is concentrically radially outside of insert 240 of the conventional sliding sleeve. One of skill in the art will appreciate that the shear release mechanism 222 is identical to that of the previous embodiment and, therefore, is not explained in detail here. Power supply to and through the tool is preferably by TEC line which is identified by numeral 340. Downhole electronics are similar to those described above and are housed in atmospheric chamber 350 bounded by electronics housing 352 and electronics cover 354. Power connections are supplied by conventional connectors 360 which are employed as desired due to convenient routing of the wire through the tools.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A wire protector comprising:

a first collar adapted to secure a wire against a tube;

a second collar adapted to secure a wire to a tube and further including an extension receivable by said first collar to provide a cover between said first collar and said second collar said cover being spaced from said tube.

2. A wire protector as claimed in claim 1 wherein said first collar includes a radiused wire bend area.

3. An actuator for a downhole tool comprising:

a driver;

a translator coupled to and driven by said driver;

a permanent downhole tool coupled to said driver such that impetus created by said driver operates said downhole tool;

a downhole processor and power delivery system operably connected to said driver to selectively operate said driver;

at least one sensor in communication with said processor and said downhole tool such that sensory information collected from said tool is transmitted to said processor for evaluation.

4. An actuator for a downhole tool as claimed in claim 3 wherein said driver is a motor.

5. An actuator for a downhole tool as claimed in claim 4 wherein said translator is an annular ball screw assembly and said motor is an annular motor.

6. An actuator for a downhole tool as claimed in claim 4 wherein said at least one sensor is a plurality of sensors.

7. An actuator for a downhole tool as claimed in claim 4 wherein said translator is an annular lead screw.

8. An actuator for a downhole tool as claimed in claim 7 wherein said screw is driven by said motor through a gear set.

9. An actuator for a downhole tool as claimed in claim 5 wherein said ball screw assembly comprises an annular ball nut and an annular ball seat, said ball screw assembly being surrounding by dielectric fluid in a compartment defined by a sealed housing to retain said fluid, said compartment being pressure balanced with a wellbore fluid.

10. An actuator for a downhole tool as claimed in claim 9 wherein said dielectric fluid is pressure balanced by at least one piston and cylinder wherein one of two ends of said at least one piston is exposed to the dielectric fluid while the other of the two ends of said piston is exposed to wellbore fluid pressure.

11. An actuator for a downhole tool comprising:

a motor;

an eccentrically mounted ball screw assembly coupled to and driven by said motor;

a downhole tool coupled to said motor such that impetus created by said motor operates said downhole tool;

a downhole processor and power delivery system operably connected to said motor to selectively operate said motor;

at least one sensor in communication with said processor and said downhole tool such that sensory information collected from said tool is transmitted to said processor for evaluation.

12. An actuator for a downhole tool comprising:

a motor having windings which are electrically energized in a selected order to rotate said annular motor in a desired direction;

an annular ball screw assembly coupled to and driven by said motor;

a downhole tool coupled to said motor such that impetus created by said motor operates said downhole tool;

a downhole processor and power delivery system operably connected to said motor to selectively operate said motor;

at least one sensor in communication with said processor and said downhole tool such that sensory information collected from said tool is transmitted to said processor for evaluation.

13. A permanent downhole flow control tool actuation device comprising:

a) a permanent downhole flow control tool including a housing having at least one motor and lead screw mounted therein, said motor being adapted to turn said lead screw clockwise and counterclockwise depending upon a selected firing order of windings in said motor; and b) a drive nut threaded onto said lead screw and connected to said permanent downhole flow control tool such that movement of said drive nut along said lead screw actuates said tool.

14. A permanent downhole flow control tool actuation device as claimed in claim 13 wherein said actuation device further includes a gearbox disposed operably between said motor and said lead screw.

15. A permanent downhole flow control tool actuation device as claimed in claim 13 wherein said at least one motor is a plurality of motors.

16. A permanent downhole flow control tool actuation device as claimed in claim 13 wherein power is supplied from a surface source.

17. A permanent downhole flow control tool actuation device as claimed in claim 13 wherein said power is supplied from a downhole source.

18. A permanent downhole flow control tool actuation device as claimed in claim 13 wherein said drive nut is connected to the permanent downhole flow control tool by a shear ring.

19. A permanent downhole flow control tool actuation device as claimed in claim 13 wherein said drive nut is connected by a dog wherein said dog is releasable.

20. A computer controlled downhole actuation device comprising:

a) a downhole tool including a housing having at least one motor and lead screw assembly mounted therein, said motor being adapted to turn said lead screw clockwise and counterclockwise depending upon a selected firing order of windings in said motor; and b) a drive nut threaded onto said lead screw and connected to said downhole tool such that movement of said drive nut along said lead screw actuates said tool;

c) at least one sensor located proximate said tool; and d) a downhole processor connected to said at least one sensor and to said motor.

21. A computer controlled downhole actuation device as claimed in claim 20 wherein said at least one sensor is a position sensor.

22. A computer controlled downhole actuation device as claimed in claim 20 wherein said at least one sensor is a flow sensor.

23. A computer controlled downhole actuation device as claimed in claim 20 wherein said at least one sensor is a plurality of sensors.

24. A computer controlled downhole actuation device as claimed in claim 20 wherein said downhole processor is housed in an atmospheric chamber of said housing.

25. A computer controlled downhole actuation device as claimed in claim 20 wherein said device is powered from a surface source.

26. A computer controlled downhole actuation device as claimed in claim 20 wherein said device is powered from a downhole source.

27. A computer controlled downhole actuation device as claimed in claim 20 wherein said device further includes a telemetry module to communicate with other one of zones in the same well, other wells, surface locations and other platforms.

28. A downhole tool actuation device comprising:

a) an outer housing supporting a winding;

b) an inner housing supporting an array of magnets, said inner housing being rotatable within said outer housing and defining a flow path axially therein;

c) an annular ball nut driveably connected to said inner housing, said ball nut being operably threaded to an annular ball seat, said seat defining a flow path axially therethrough and coaxially with said inner housing flow path and being longitudinally displaceable;

d) a sliding sleeve having a sleeve housing and a sleeve insert, said sleeve housing being connected to said outer housing of said device and said sleeve insert being connected to said ball seat such that axial movement of said ball seat is transmitted to said sleeve insert.

29. A downhole tool actuation device comprising:

a) an outer housing supporting a winding;

b) an inner housing supporting an array of magnets, said inner housing being rotatable within said outer housing and defining a flow path axially therein;

c) an annular ball nut driveably connected to said inner housing, said ball nut being operably threaded to an annular ball seat, said seat defining a flow path axially therethrough and coaxially with said inner housing flow path and being longitudinally displaceable;

d) a sliding sleeve having a sleeve housing and a sleeve insert, said sleeve housing being connected to said outer housing of said device and said sleeve insert being connected to said ball seat such that axial movement of said ball seat is transmitted to said sleeve insert;

e) a resolver mounted to said outer housing and in communication with said inner housing via a ring gear, said resolver providing position information.

30. A downhole tool actuation device as claimed in claim 29 wherein said device further includes an electronics and processor package connected to said motor and resolver, said package receiving information from said resolver and directing said motor.

31. A downhole tool actuation device as claimed in claim 30 wherein said device further includes at least one sensor.

32. A downhole tool actuation device as claimed in claim 31 wherein said at least one sensor is a plurality of sensors.

33. A downhole tool actuation device as claimed in claim 29 wherein said resolver receives a sine wave signal and generates a cosine wave signal in response, said cosine wave being determined by position information obtained by said resolver.

34. A downhole tool actuation device as claimed in claim 32 wherein said device further includes a downhole electronics and processor package and wherein said resolver communicates with said package and said package calculates a position of said sleeve insert.

35. A downhole tool actuation device as claimed in claim 33 wherein said package communicates said position to a surface location.

* * * * *

UNITED STATES PATENT AND TRADEMARK OFFICE

CERTIFICATE OF CORRECTION

PATENT NO. : 6,041,857

DATED : March 28, 2000

INVENTOR(S) : Michael A. Carmody et al

It is certified that error appears in the above-identified patent and that said Letters Patent are hereby corrected as shown below:

Column 1, line 6, delete "an" and insert therefor --any--
Column 5, line 34, delete "field" and insert therefor --filed--
Column 8, line 49, delete "Resolver" and insert therefor --resolver--
Column 11, line 3, delete "require" and insert therefor --required--
Column 13, line 14, delete "surrounding" and insert therefor --surrounded--

Signed and Sealed this

Third Day of April, 2001

*Attest:*

Nicholas P. Godici

NICHOLAS P. GODICI

*Attesting Officer*

*Acting Director of the United States Patent and Trademark Office*